US007986910B2

(12) United States Patent
Kabata et al.

(10) Patent No.: US 7,986,910 B2
(45) **Date of Patent: *Jul. 26, 2011**

(54) LUBRICANT COATER, IMAGE BEARING UNIT, AND IMAGE FORMING APPARATUS

(75) Inventors: Toshiyuki Kabata, Yokohama (JP); Kumiko Hatakeyama, Sagamihara (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 392 days.

This patent is subject to a terminal disclaimer.

(21) Appl. No.: 12/177,475

(22) Filed: Jul. 22, 2008

(65) Prior Publication Data

US 2009/0028618 A1 Jan. 29, 2009

(30) Foreign Application Priority Data

Jul. 23, 2007 (JP) ..... 2007-190407

(51) Int. Cl.

| | |
|---|---|
| ***G03G 15/00*** | (2006.01) |
| ***G03G 15/20*** | (2006.01) |
| ***G03G 21/00*** | (2006.01) |
| ***G03G 13/08*** | (2006.01) |

(52) U.S. Cl. ..... 399/346; 399/71; 399/123; 399/343; 399/350; 430/123.42

(58) Field of Classification Search ..... 399/71, 399/123, 346, 350; 184/14; 430/123.42
See application file for complete search history.

(56) References Cited

U.S. PATENT DOCUMENTS

| | | | | |
|---|---|---|---|---|
| 6,686,114 | B2 * | 2/2004 | Sakon et al. | 430/123.42 |
| 7,734,242 | B2 * | 6/2010 | Hatakeyama et al. | 399/346 |
| 7,738,829 | B2 * | 6/2010 | Hatakeyama et al. | 399/346 |
| 2001/0031411 | A1 * | 10/2001 | Kojima et al. | 430/58.05 |
| 2005/0191099 | A1 * | 9/2005 | Yamaguchi et al. | 399/346 |
| 2005/0196193 | A1 * | 9/2005 | Tamoto et al. | 399/111 |
| 2006/0133872 | A1 * | 6/2006 | Sugiura et al. | 399/346 |
| 2007/0015074 | A1 * | 1/2007 | Sugino et al. | 430/59.6 |
| 2007/0258743 | A1 * | 11/2007 | Shakuto et al. | 399/346 |
| 2008/0089726 | A1 | 4/2008 | Hatakeyama et al. | |
| 2008/0118286 | A1 | 5/2008 | Yamashita et al. | |

FOREIGN PATENT DOCUMENTS

| | | |
|---|---|---|
| JP | 51-22380 | 2/1976 |
| JP | 2597515 | 1/1997 |
| JP | 2002-97483 | 4/2002 |
| JP | 2004-198662 | 7/2004 |
| JP | 2005-4051 | 1/2005 |
| JP | 2005-17469 | 1/2005 |
| JP | 2005-249901 | 9/2005 |
| JP | 2005-274737 | 10/2005 |
| JP | 2007-286594 | 11/2007 |
| JP | 2008-224999 | 9/2008 |

* cited by examiner

*Primary Examiner* — David M Gray
*Assistant Examiner* — Francis Gray
(74) *Attorney, Agent, or Firm* — Cooper & Dunham LLP

(57) ABSTRACT

The present invention provides a lubricant coater including an applying member for applying a lubricant powder on a surface of an image bearing member, wherein the lubricant powder contains paraffin as a main component, and the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

6 Claims, 5 Drawing Sheets

LUBRICANT COATER, IMAGE BEARING UNIT, AND IMAGE FORMING APPARATUS

BACKGROUND

1. Technical Field

This disclosure relates to a lubricant coater for applying a lubricant on a surface of an image hearing member such as photoconductor, and also relates to an image bearing unit using the lubricant coater, and an image forming apparatus using the lubricant coater.

2. Description of the Related Art

An electrophotographic image forming apparatus generally forms an image according to the following process. Firstly, an image bearing member such as photoconductor whose surface has been uniformly charged by a charging device is subjected to laser scanning to form a latent electrostatic image, and the latent electrostatic image is developed by a developing device to form a toner image. Subsequently, a toner image obtained by the developing step is directly transferred onto a recording medium such as transfer paper from the image bearing member or transferred onto recording paper via an intermediate transfer member. A slight amount of untransferred toner adheres to the surface of the image bearing member after the transferring step. The untransferred toner is then removed from the surface of the image bearing member by a cleaning member such as cleaning blade.

With the above configuration, a surface of an image bearing member is sometimes abraded away with time by mechanical stress associated with abrasion by a cleaning member. Such abrasion reduces the operating life of the image bearing member.

Moreover, a surface of an image bearing member is deteriorated by electrostatic discharge caused in between the image bearing member and a charging device when being uniformly charged by the charging device. In recent years, a so-called AC charging device system has become frequently used, in which electrostatic discharge is induced at several hundreds times to several thousands times per second in between a charging member that applies a charge bias containing alternating current components such as a charging roller and an image bearing member. Those AC charging device systems have an advantage in that they produce less acidic gas such as ozone and NOx than electrostatic charger systems, however, they have a disadvantage in that the degree of deterioration of an image bearing member associated with electrostatic discharge is much higher than those of electrostatic charger systems.

As the image quality is improved in recent years, a toner used in image formation tends to be made smaller and more spherical and is likely to pass through between the image bearing member and the cleaning blade. When the toner passes through therebetween, the image quality is degraded due to defective charging of the image bearing member and defective exposure during the optical scanning.

In the meanwhile, an image forming apparatus has been conventionally known, which is equipped with a lubricant coater for applying a zinc stearate powder as a lubricant over a surface of an image bearing member as described in Japanese Patent Application Publication (JP-B) No. 51-22380, for example. In this type of image forming apparatus, the zinc stearate powder applied to the surface of the image bearing member reduces the friction between the image bearing member and the cleaning member, thereby preventing the abrasion of the image bearing member. The zinc stearate powder also reduces the adhesion of residual toner to the image bearing member so that the toner hardly passes through a contact portion between the cleaning member and the image bearing member. Moreover, a film made of the zinc stearate powder absorbs electrostatic discharge energy when being charged to prevent the degradation of the image bearing member due to electrostatic discharge.

However, in this type of the image forming apparatus, the image quality is easily degraded by the generation of fatty acids on the surface of the image bearing member. Specifically, zinc stearate is a metal soap and generates zinc and fatty acids when the zinc stearate is decomposed. When the zinc stearate is decomposed by electrostatic discharge when being charged and fatty acids are generated on the surface of the image bearing member, the lubrication property is degraded, and the toner is likely to adhere to the surface of the image bearing member in a film form. When the adhesion occurs, the resolution of the image is reduced, and the image density becomes uneven. Thus, in a conventional image forming apparatus, a large amount of zinc stearate has been continued to be applied onto an image bearing member to protect the surface of the image bearing member from the fatty acids generated in accordance with the decomposition of the zinc stearate and to maintain excellent lubrication property. Therefore, a mass of the zinc stearates dries up in a short period of time, it is necessary to supply a mass of the zinc stearate many times before the end of the operating life of the image bearing member.

Japanese Patent Application Laid-Open (JP-A) No. 2005-274737 proposes a lubricant mainly composed of higher alcohol having 20 to 70 carbon atom to replace the zinc stearate. According to JP-A No. 2005-27437, in this structure, it is possible to maintain the lubrication property for a long period of time by giving appropriate wettability to the surface of the image bearing member while the higher alcohol stays on the surface of the cleaning member as indefinite particles.

Japanese Patent Application Laid-Open (JP-A) No. 2002-97483 proposes a lubricant composed of a powder of a specific alkylene bis alkyl acid amide compound. According to JP-A 2002-97483, with this lubricant, by placing the lubricant powder on a contact interface between a cleaning member and a surface of an image bearing member, it is possible to maintain the smooth lubrication effects for a long period of time.

However, with the use of the lubricant described in JP-A 2005-274737, a surface of an image bearing member cannot be sufficiently protected from stress caused by electrostatic discharge, although the lubricant can enhance the lubrication property of the image bearing member with respect to a cleaning member and a toner used. Specifically, since the adsorption occupying area per molecule of higher alcohol molecules adsorbed to the surface of the image bearing member can be relatively wide (the molecules can be easily wider on the surface), a sufficient amount of higher alcohol molecules cannot exist in a unit area of the image bearing member. Thus, the stress caused by electrostatic discharge can be easily passed to the surface of an image bearing member via a protective layer made of a lubricant. Thus, the surface of the image bearing member cannot be sufficiently protected from stress caused by electrostatic discharge.

Moreover, the lubricant described in JP-A 2002-97483 is composed of a compound containing nitrogen atoms in its molecules. As the lubricant is decomposed under the stress due to electrostatic discharge, ion dissociatable compounds such as nitrogen oxides and ammonium containing compounds can be generated. When the ion dissociatable compounds are incorporated into a layer of the lubricant, the resistance of the layer of the lubricant is reduced under a high humidity environment. Accordingly, a current is leaked from a latent electrostatic image of an image bearing member, and image blur occurs.

BRIEF SUMMARY

In an aspect of this disclosure, there is provided a new lubricant containing paraffin as a primary component. Although a powder of the lubricant is decomposed by electrostatic discharge between a charging device and an image bearing member, fatty acids are hardly generated. Thus, the lubricant hardly causes degradation of the lubrication property caused by the effect of fatty acids and toner adhesion.

Further, excellent lubrication property can be maintained for a long period of time. Furthermore, a surface of an image bearing member can be favorably protected from stress caused by electrostatic discharge by forming a film composed of the powder on the surface of the image bearing member.

However, when this lubricant is used, fine streaks sometimes occur on an image.

The inventors have diligently examined the cause of these fine streaks and found out that a relatively thicker portion of the film of the lubricant formed on a surface of an image bearing member prevents exposure to the image bearing member to cause such a formation defect of the latent electrostatic image.

In another aspect of this disclosure, there are provided a lubricant coater and image forming apparatus. Specifically, provided are a lubricant coater and an image forming apparatus which are capable of maintaining excellent lubrication property between an image bearing member and a cleaning member for a long period of time, efficiently protecting the surface of the image bearing member from stress caused by electrostatic discharge, and preventing the occurrence of fine-streaky images caused by defective exposure of the image hearing member.

The lubricant coater and image forming apparatus can include various features such as for example, the following.

The means to achieve the above-mentioned object are as follows.

<1> A lubricant coater including:

an applying member for applying a lubricant powder on a surface of an image bearing member, wherein the lubricant powder contains paraffin as a main component, and wherein the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

<2> The lubricant coater according to the item <1>, wherein the image bearing member is a photoconductor provided with a photosensitive layer containing a polycarbonate resin; and in C1s spectrum of an x-ray photoelectron spectroscopy (XPS), among a plurality of waveforms generated by a plurality of carbon bond structures which are different from each other in the C1s spectrum, when a dimensional ratio of a composite waveform composed of a plurality of waveforms having peaks of intensity within the range of bond energy values of 290.3 eV to 294 eV relative to the entire dimension of the plurality of waveforms under the C1s spectrum is defined as a dimensional ratio A, a relation between a dimensional ratio A0 [%] corresponding to the dimensional ratio A of the surface of the photoconductor to which the lubricant has not yet been applied and a dimensional ratio At [%] corresponding to the dimensional ratio A of the surface of the photoconductor to which the lubricant has been continuously applied for 120 minutes satisfies a condition of "(A0−At)/A0×100≧70 [%]".

<3> The lubricant coater according to any one of the items <1> and <2>, wherein the lubricant is a lubricant containing 40% by mass or more of a paraffin having a melting point of 70° C. to 130° C.

<4> An image bearing unit including:

an image bearing member for supporting a toner image on its surface, and a lubricant applying unit configured to apply a lubricant on the surface of the image bearing member, wherein as the lubricant applying unit, the lubricant coater according to the items <1> to <3> is used.

<5> An image forming apparatus including:

an image bearing unit which is equipped with:

an image bearing member for supporting a toner image on its surface, and a lubricant applying unit configured to apply a lubricant on the surface of the image bearing member, and an image forming unit configured to form a toner image on the surface of the image bearing member, wherein as the image bearing unit, the image bearing unit according to the item <4> is used.

<6> An image forming apparatus including:

an image bearing member for supporting a toner image on its surface, a lubricant applying unit configured to apply a lubricant on the surface of the image bearing member, and an image forming unit configured to form a toner image on the surface of the image bearing member, wherein as the lubricant applying unit, the lubricant coater according to any one of the items <1> to <3> is used.

In the aforementioned lubricant coater as a powder of lubricant or a lubricant in powder form, a powder of lubricant containing paraffin as a main component is used. With this setting, as is clarified by the experiments made by the inventors, which will be described hereinafter, it is possible to maintain excellent lubrication property between an image bearing member and a cleaning member for a long period of time and to efficiently protect the surface of the image bearing member from stress caused by electrostatic discharge.

Further, as is clarified by the experiments made by the inventors, which will be described hereinafter, it is possible to prevent the occurrence of fine-streaky images caused by defective exposure of an image bearing member by controlling a maximum thickness of a lubricant film formed on a surface of an image bearing member, which is obtained when the lubricant powder is continuously applied for 120 minutes, so as to be 0.25 μm or less.

DETAILED DESCRIPTION OF THE INVENTION

Hereinafter, as an image forming apparatus in which a lubricant coater of the present invention is used, an embodiment of a copier which forms images by electrophotography will be described.

Figure 1:
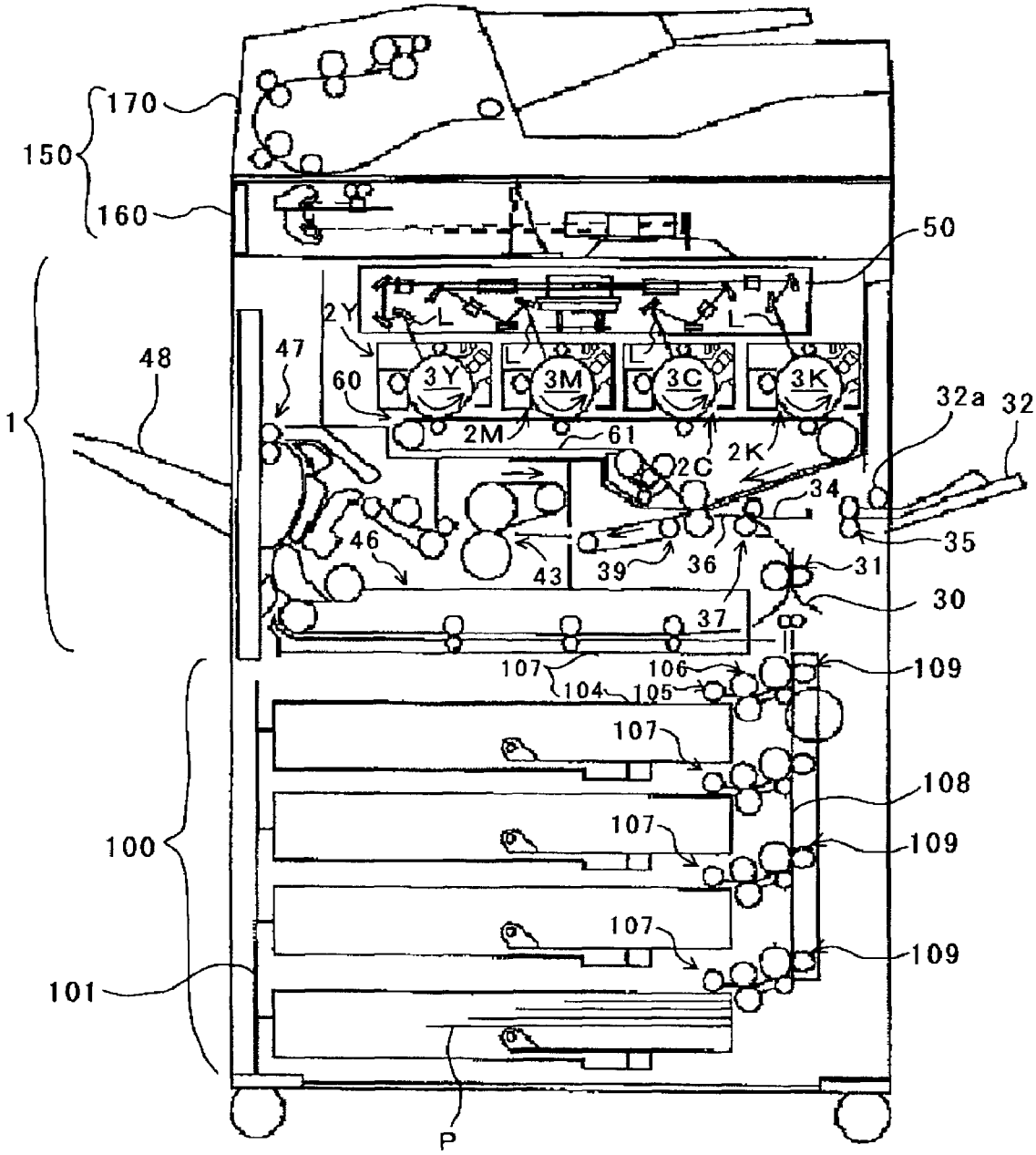
FIG. 1 is a schematic structural view showing one example of a copier relating to embodiments of the present invention.

Firstly, the basic structure of a copier according to this embodiment will be described. FIG. 1 is a schematic structural view showing a copier according to this embodiment. This copier is equipped with a printer section 1, a printer section 1, white-paper feeding unit 100, and a document conveying-reading unit 150. The document conveying-reading unit 150 has the scanner 160 as a document reader, which is fixed on the printer section 1, and an auto document feeder (ADF) 170 as a document conveying unit, which is supported by the scanner 160.

The white-paper feeding unit 100 is provided with four paper feed units 107 which are mounted in a multistage arrangement in a paper bank 101, paper feed path 108, a plurality of pair of conveying rollers 109 and the like. Each of the four paper feed units 107 is composed of a paper feed cassette 104, a paper feed roller 105, a pair of separation rollers 106, and the like.

In each of the paper feed units 107, sheets of recording paper P are housed in the paper feed cassette 104 in a state where a plurality of sheets are stacked in a bundle. One of paper feed rollers 105 is driven to rotate based on a control signal sent from the printer section 1, and the uppermost sheet of the recording paper P in the bundle is sent out toward the paper feed path 108. The sheets of recording paper P sent are separated one by one by the pair of separation rollers 106, sent through to the paper feed path 108 and then sent to a first receiving branch path 30 in the printer section 1 via a conveyance nip between the plurality of pair of conveying rollers 109 provided on the paper feed path 108.

The printer section 1 is equipped with four process units 2Y, 2M, 2C and 2K for forming toner images in yellow (Y), magenta (M), cyan (C) and black (K) colors. The printer section 1 is also equipped with the first receiving branch path 30, a pair of receiving-conveying rollers 31, a manual feed tray 32, a second receiving branch path 34, a pair of manual separation rollers 35, a pre-transfer conveyance path 36, a pair of resist rollers 37, a conveyance belt unit 39, a fixing unit 43, a switch back unit 46, a pair of paper ejection rollers 47, an output tray 48, an optical writing unit 50, a transfer unit 60 and the like. Note that the process units 2Y, 2M, 2C and 2K serving as image bearing member units have drum-shaped photoconductors 3Y, 3M, 3C and 3K respectively, which are arranged with a predetermined pitch.

The pre-transfer conveyance path 36 for conveying the recording paper P just before a secondary transfer nip, which will be described below, is branched into the first receiving branch path 30 and the second receiving branch path 34 at the upstream in the paper conveyance direction. The recording paper P sent from the paper feed path 108 in the white-paper feed unit 100 is received by the first receiving branch path 30 in the printer section 1 and is then sent to the pre-transfer conveyance path 36 via a conveyance nip between the pair of receiving-conveying rollers 31 provided on the first receiving branch path 30.

On a side surface of a housing of the printer section 1, the manual feed tray 32 is provided so as to be capable of being opened and closed, and a bundle of paper sheets are manually fed on the top surface in a state where the manual feed tray 32 is opened in relation to the housing. The uppermost recording paper sheet in the paper bundle fed manually is sent out toward the second receiving branch path 34 by a sending roller 32*a* provided at the manual feed tray 32 and sent are separated one by one by the pair of manual separation rollers 35, and then sent to the pre-transfer conveyance path 36.

The optical writing unit 50 has a laser diode, a polygon mirror and various types of lenses (all of which are not shown), drives the laser diode based on image information read by the scanner 160 to be hereinafter described and image information sent from external personal computers, and then optically scans images which are formed on surfaces of the photoconductors 3Y, 3M, 3C, and 3K in the process units 2Y, 2M, 2C, and 2K. Specifically, each of the photoconductors 3Y, 3M, 3C and 3K in the process units 2Y, 2M, 2C and 2K is driven to rotate in a counterclockwise direction in the figure by each driving unit (not shown). The optical writing unit 50 performs optical scanning of the surface to be scanned by irradiating laser light L to the photoconductors 3Y, 3M, 3C and 3K while the laser light L being polarized in the rotating shaft line direction of each of the photoconductors, whereby latent electrostatic images based on the image information of Y, M, C, and K are formed on surfaces of the photoconductors 3Y, 3M, 3C and 3K.

Figure 2:
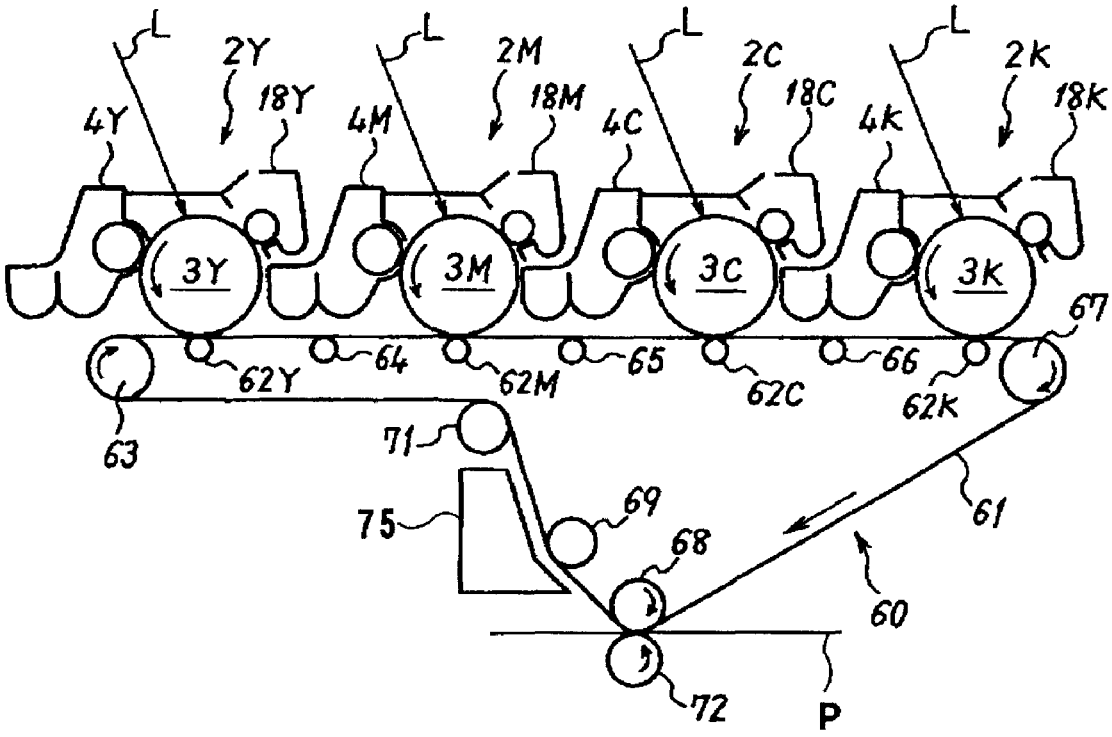
FIG. 2 is a partially enlarged structural view showing part of internal structure of printer section of the copier shown in FIG. 1.

FIG. 2 is a partially enlarged structural view showing part of internal structure of the printer section 1. The process units for each color 2K, 2Y, 2M and 2C respectively have as one unit a photoconductor as an image bearing member and various devices which are arranged around the photoconductor so as to sustain them, and the photoconductor and the various devices are detachably mounted to the body of the printer section. The process units 2K, 2Y, 2M and 2C respectively have the same configuration except that the color of toner used therein differs from each other. For instance, in the case of the process unit 2Y for Y toner, the process unit 2Y has the photoconductor 3Y and a developing device 4Y for developing a latent electrostatic image formed on the photoconductor 3Y into a Y toner image. The process unit 2Y also has a drum cleaning device 18Y configured to remove untransferred toner adhering the surface of the photoconductor 3Y, the untransferred toner has passed through a primary transfer nip for Y toner (to be hereinafter described), and so on. This type of copier has a structure permitting a so-called tandem mode in which the four process units 2Y, 2M, 2C and 2K are disposed along the endless-moving direction of an intermediate transfer belt 61 to be hereinafter described.

Figure 3:
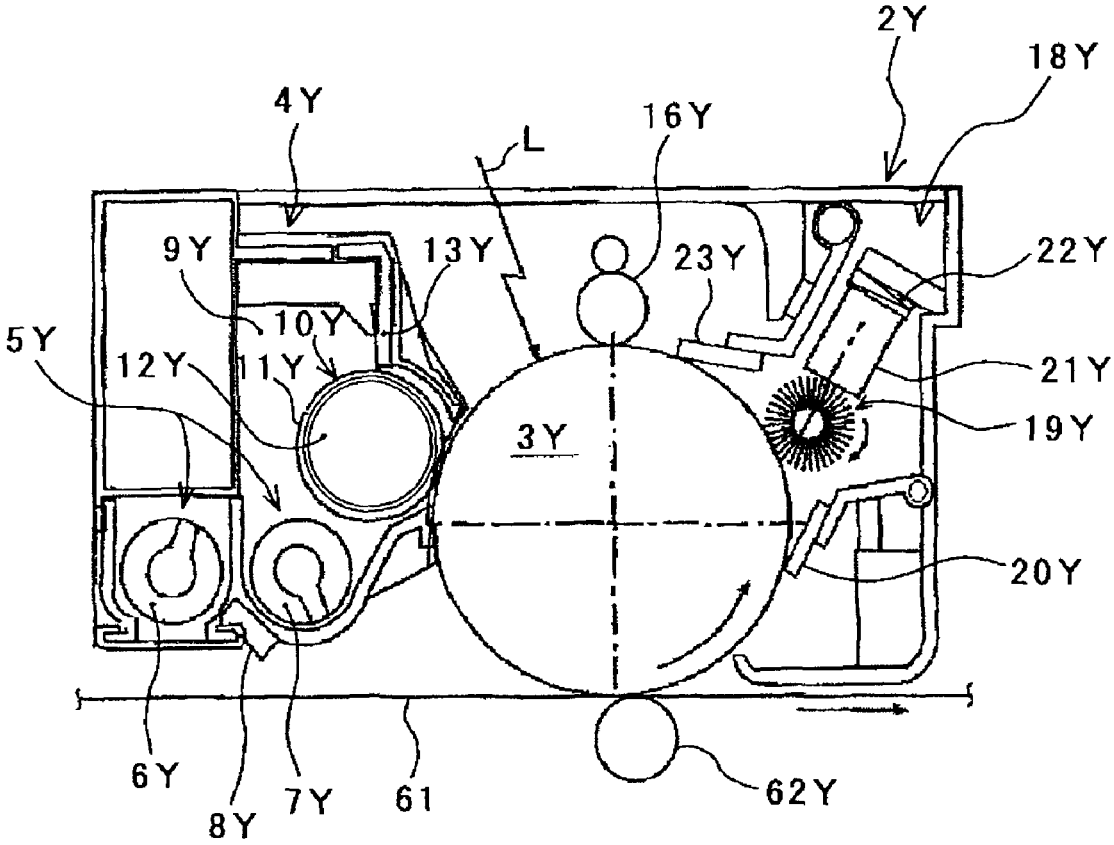
FIG. 3 is an enlarged structural view showing a process unit for Y (yellow toner in the printer section shown in FIG. 2.

FIG. 3 is an enlarged structural view showing the process unit 2Y for Y toner. As is shown in FIG. 3, the process unit 2Y has the developing device 4Y, the drum cleaning device 18Y and an electrostatic charge roller 16Y around the photoconductor 3Y, and also has a charge eliminating lamp (not shown).

The surface of the photoconductor 3Y passes through a position of being uniformly charged by the electrostatic charge roller 16Y before entering the position of the above-mentioned optical scanning by the optical writing unit 50 along with the rotation thereof. To the electrostatic charge roller 16Y, a charge bias in which an alternating current is overlaid on a direct current voltage is applied from a power source (not shown). The electrostatic charge roller 16Y is placed so as to make contact with or closely contact with the surface of the photoconductor 3Y to generate electrostatic discharge between itself and the photoconductor 3Y. The surface of the photoconductor 3Y is uniformly charged with the same polarity as the normal charge polarity of Y toner. As an electrostatically charging member, in place of the electrostatic charge roller 16Y, an electrostatically charging brush roller may be used, which is equipped with a rotation shaft member made of metal and a brush roller section composed of a plurality of electrically conductive fiber filaments which are formed so as to be raised vertically on the circumferential face of the rotation shaft member.

As a charging device for uniformly charging the surface of the photoconductor 3Y, in place of a roller type charger and a brush type charger, a corona discharge type charger such as a corotron charger and a scorotoron charger may be used. The roller type charger and the brush type charger can greatly reduce ozone generation as compared to corona discharge type chargers.

In the surface of the photoconductor 3Y that has been uniformly charged by the electrostatic charge roller 16Y, the potential of an exposed area is reduced by optical attenuation in optical scanning with use of the laser light L, whereby a latent electrostatic image is formed on the surface of the photoconductor 3Y. The potential of the latent electrostatic image has also the same polarity as the normal charge polarity of Y toner, however, the absolute value of the potential is much lower than that of the potential at the image background portion of the photoconductor 3Y.

The photoconductor 3Y is a so-called organic photoconductor (OPC) having an organic photoconductive layer. As for the photoconductor 3Y, a drum-shaped photoconductor is used in which a photosensitive layer formed by applying an organic photosensitive material having photosensitivity over a surface of a conductive substrate. As the conductive substrate for the photoconductor 3Y, a substrate composed of a material exhibiting conductivity with a volume resistance of $10^{10}$[Ω·cm] or less is used. For example, those prepared by coating a plastic or paper in a predetermined form (in a film or cylinder form, etc.) with a metal such as aluminum, nickel, chrome, nichrome, copper, gold, silver and platinum or a metal oxide such as tin oxide and indium oxide by deposition or sputtering are exemplified. Besides the above-mentioned, a metal drum-shaped tube may also be used, which is made of metal such as aluminum, nickel and stainless, formed by a solid-drawn process or extrusion process and whose surface is subjected to a surface treatment such as cutting, surperfinishing and grinding.

For the drum-shaped substrate for the photoconductor 3Y, those having a diameter of 20 mm to 150 mm, preferably having 24 mm to 100 mm, and still more preferably having 28 mm to 70 mm are exemplified. A substrate of 20 mm or less in diameter makes it physically difficult to arrange devices for use in respective steps of charging, exposing, developing, transferring, and cleaning around the drum-shaped photoconductor. A substrate of 150 mm or more in diameter is not suitable for the photoconductor because a large-size image forming apparatus must be provided. Particularly in a tandem type image forming apparatus, it is necessary to mount a plurality of photoconductors, and thus the diameter of the substrate is preferably 70 mm or less and more preferably 60 mm or less. The endless nickel belt and endless stainless steal belt disclosed in Japanese Patent Application Laid-Open (JP-A) No. 52-36016 can also be used for the conductive substrate.

As the photosensitive layer of the photoconductor 3Y, it is possible to employ any of a single layer type in which a charge generating material and a charge transporting material are mixed; a sequential order type layer formation in which a charge transporting layer is formed on a charge generating layer, and a reverse order type layer formation in which a charge generating layer is formed on a charge transporting layer. For the purpose of improving the mechanical strength, frictional resistance, anti-gas property, cleanability and the like of the photoconductor 3Y, a protective layer may be formed on the photosensitive layer. Further, an undercoat layer may be formed between the photosensitive layer and the conductive substrate. In each of the layers formed, a plasticizer, antioxidant, a leveling agent and the like may be added in an appropriate amount in accordance with the necessity.

For the undercoat layer of the photoconductor 3Y, those composed primarily of a resin or a white pigment and a resin, and those made of a metal oxide film or the like formed by chemically or electrochemically oxidizing a conductive substrate surface with the resin are exemplified. Of these, an undercoat layer composed primarily of a white pigment and a resin is preferably used. Examples of the white pigment include metal oxides such as titanium oxide, aluminum oxide, zirconium oxide and zinc oxide. Of these white pigments, it is preferable to contain titanium oxide, which is superior in preventing injection of charge from a conductive substrate, in the undercoat layer. Examples of the resin to be used in the undercoat layer include thermoplastic resins such as polyamide resins, polyvinyl alcohol resins, casein resins, and methyl cellulose resins; and thermosetting resins such as acrylic resins, phenol resins, melamine resins, alkyd resins, unsaturated polyester resins, and epoxy resins. These resins may be used alone or in combination.

Examples of the charge generating material to be used in the photosensitive layer of the photoconductor 3Y include azo pigments such as monoazo pigments, bis-azo pigments, tris-azo pigments, and tetrakis pigments; organic pigments and dyes such as triaryl methane pigments, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments, and phthalocyanine pigments; and inorganic materials such as such as selenium, selenium arsenic, selenium-tellurium, cadmium sulfide, zinc oxide, titanium oxide and amorphous silicon. These materials may be used alone or in combination.

Examples of the charge transporting material to be used in the photosensitive layer of the photoconductor 3Y include anthracene derivatives, pyrene derivatives, carbazole derivatives, tetrazole derivatives, metallocene derivatives, phenothiazine derivatives, pyrazoline compounds, hydrozone compounds, styryl compounds, styryl hydrazone compounds, enamine compounds, butadiene compounds, distyryl compounds, oxazole compounds, oxadiazole compounds, thiazole compounds, imidazole compounds, triphenyl amine derivatives, phenylene amine derivatives, amino stilbene derivatives, and triphenyl methane derivatives. These charge transporting materials may be used alone or in combination.

For a binder resin to be used for forming the charge generating layer composed of charge generating material(s) and the charge transporting layer composed of charge transporting material(s), it has electric insulation properties, and examples thereof include thermoplastic resins, thermosetting resins, photocurable resins and photoconductive resins. Examples of the binder resin include thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyester, phenoxy resins, (meth)acrylic resins, polystyrene, polycarbonate, polyarylate, polysulfone, polyether sulfone, and ABS resins; thermosetting resins such as phenol resins, epoxy resins, urethane resins, melamine resins, isocyanate resins, alkyd resins, silicone resins, and thermosetting acrylic resins;

and photoconductive resins such as polyvinyl carbazole, polyvinyl anthracene, and polyvinyl pyrene. These binder resins may be used alone or in combination. Particularly, as a binder resin for the charge transporting layer, polycarbonate is preferable because it has high mechanical strength, is transparent, and does not cause reduction in photosensitivity of photoconductors.

Examples of the antioxidant to be contained in layers of the photoconductor 3Y, such as the photosensitive layer, include monophenol compounds, bisphenol compounds, polymeric phenol compounds, paraphenylene diamines, hydroquinones, and organic sulfur compounds.

Examples of the monophenol compounds used as the antioxidant include 2,6-di-t-butyl-p-cresol, butylated hydroxyanisole, 2,6-di-t-butyl-4-ethylphenol, stearyl-β-(3,5-di-t-butyl-4-hydroxyphenyl) propionate, and 3-t-butyl-4-hydroxyanisole.

Examples of the bisphenol compounds used as the antioxidant include 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

Examples of the polymeric phenol compounds used as the antioxidant include 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocophenols.

Examples of the paraphenylene diamines used as the antioxidant include N-phenyl-N'-isopropyl-p-phenylenediamine, N, N'-di-sec-butyl-p-phenylenediamine, N-phenyl-N-sec-butyl-p-phenylenediamine, N, N'-di-isopropyl-p-phenylenediamine, and N,N'-dimethyl-N,N'-di-t-butyl-p-phenylenediamine.

Examples of the hydroquinones used as the antioxidant include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds used as the antioxidant include dilauryl-3,3'-thiodipropyonate, distearyl-3,3'-thiodipropyonate, and ditetradecyl-3,3'-thiodipropyonate.

Examples of the organic phosphorus compounds used as the antioxidants include triphenyl phosphine, tri(nonylphenyl)phosphine, tri(dinonylphenyl)phosphine, tricresyl phosphine, and tri(2,4-dibutylphenoxy)phosphine.

For the plasticizer to be contained in layers of the photoconductor 3Y, such as the photosensitive layer, those used as plasticizers for common resins such as dibutylphthalate, and dioctyl phthalate can be employed. The use amount of the plasticizer is approximately 0 parts by mass to 30 parts by mass based on 100 parts by mass of the binder resin.

A leveling agent may be added in the charge transporting layer of the photoconductor 3Y. Examples of the leveling agent include silicone oils such as dimethylsilicone oil and methylphenyl silicone oil. A polymer having perfluoroalkyl groups at the side chains or oligomer can be used as the leveling agent. The use amount of the leveling agent is approximately 0 parts by mass to 1 part by mass based on 100 parts by mass of the binder resins.

When a surface layer is formed on the photosensitive layer for the purpose of improving the mechanical strength, frictional resistance, anti-gas property, cleanability and the like, for the surface layer, a surface layer containing a polymer having higher mechanical strength than that of the photosensitive layer, and a surface layer in which an inorganic filler is dispersed in a polymer are exemplified. As the polymer to be used in the surface layer, any of a thermoplastic polymer and a thermosetting polymer may be used, however, a thermosetting polymer is preferable because it has high mechanical strength and has extremely high capability of preventing the friction and abrasion between a photoconductor and a cleaning blade. There is no problem even when the surface layer has no charge transportability, provided that it has thin film thickness, however, when a surface layer having no charge transportability is formed thick, it is likely to cause a reduction in photosensitivity of the photoconductor, an increase in surface potential after exposure and an increase in residual potential. For this reason, it is preferable to add the above-mentioned charge transporting material in the surface layer, and it is also preferable to use a polymer having charge transportability as the polymer for the protective layer. Since in general, the photosensitive layer and the surface layer greatly differ in mechanical strength, the protective layer is abraded away by the friction between itself and a cleaning blade to be hereinafter described, is partially or fully removed and then the photosensitive layer abrades away soon. Therefore, when a surface layer is provided, it is important to secure a sufficient thickness for the surface layer. The thickness of the surface layer is 0.01 μm to 12 μm, preferably 1 μm to 10 μm, and still more preferably 2 μm to 8 μm. When the thickness of the surface layer is 0.1 μm or less, the surface layer is excessively thin, is liable to be partially removed due to the friction with a cleaning blade used, and inconveniently, abrasion accelerates the deterioration of the photosensitive layer from the removed portion. When the thickness of the surface layer is 12 μm or more, it is liable to cause a reduction in photosensitivity, an increase in surface potential after exposure and an increase in residual potential. Particularly when a polymer having charge transportability is used for the surface layer, it is unfavorable because the polymer having charge transportability itself costs high.

For the polymer to be used in the surface layer of the photoconductor 3Y, besides polycarbonate resins, materials which are transparent to writing laser beam at the time of image formation and are excellent in insulating properties, mechanical strength and adhesion may be mixed for use. Examples of such materials include resins such as ABS resins, ACS resins, olefin-vinyl monomer copolymers, chlorinated polyethers, diallylphthalate resins (allyl resins), phenol resins, polyacetals, polyamides, polyamideimides, polyacrylates, polyallylsulfones, polybutylenes, polybutylene terephthalate, polyethersulfones, polyethylenes, polyethylene terephthalates, polyimides, acrylic resins, polymethylpentenes, polypropylenes, polyphenylene oxides, polysulfones, polystyrenes, AS resins, butadiene-styrene copolymers, polyurethanes, polyvinyl chlorides, polyvinylidene chlorides, and epoxy resins. Each of these polymers may be a thermoplastic polymer, however, in order to enhance the mechanical strength of the polymer, the polymer is crosslinked with a crosslinker having a polyfunctional acryloyl group, carboxyl group, hydroxyl group, amino group or the like so as to be a thermosetting polymer, and the use of the thermosetting polymer makes it possible to enhance the mechanical strength of the surface layer, hereby abrasion due to the friction with a cleaning blade can be drastically reduced.

As described above, the surface layer preferably has charge transportability. As a method of imparting charge transportability to the surface layer, the following methods are exemplified for example, a method of using a mixture prepared by mixing a polymer to be used in the surface layer and the above-mentioned charge transporting material; and a method of using a polymer having charge transportability in the surface layer. The latter method is preferable because a photoconductor having high-photosensitivity and casing less increase in surface potential and less increase in residual potential can be obtained thereby.

As the polymer having charge transportability, those containing a group having charge transportability are exemplified. Examples of the group include those represented by the following Chemical Formula.

Chemical Formula 1

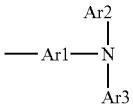

(In Chemical Formula 1, "$Ar_1$" is a substituted or an unsubstituted allylene group; "$Ar_2$" and "$Ar_3$" respectively represent a substituted or an unsubstituted aryl group and may be the same or different from each other.)

It is preferable that the group having charge transportability be added to side chains of a polymer having high mechanical strength such as polycarbonate resins and acrylic resins. It is preferable to use acrylic resin, because it allows for easy production of monomers and is excellent in coating property and curability. An acrylic resin having charge transportability is prepared by polymerization of an unsaturated carboxylic acid having a group represented by Chemical Formula 1. With the use of the acrylic resin, a surface layer being excellent in transparency and having high-mechanical strength and high-charge transportability can be formed. Further, the mechanical strength of the surface layer can be made extremely high by mixing a monofunctional unsaturated carboxylic acid having a group represented by Chemical Formula 1 with a polyfunctional unsaturated carboxylic acid, preferably, with a trifunctional or higher functional unsaturated carboxylic acid to form an acrylic resin having a crosslinked structure, and using the acrylic resin as a thermosetting polymer. A group represented by Chemical Formula 1 may be added to the polyfunctional unsaturated carboxylic acid, however, the production cost of the monomer becomes expensive. Therefore, it is preferable to use a photocurable polyfunctional monomer, instead of adding a group represented by Chemical Formula 1 to the polyfunctional unsaturated carboxylic acid.

For the monofunctional unsaturated carboxylic acid having a group represented by Chemical Formula 1, those represented by any one of the following Chemical Formulas 2 and 3 are exemplified.

Chemical Formula 2

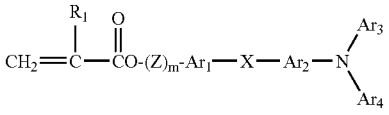

Chemical Formula 3

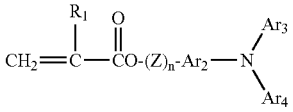

(In Chemical Formulas 2 and 3, $R_1$ represents any one of a hydrogen atom, a halogen atom, an alkyl group that may have a substituent, an aralkyl group that may have a substituent, an aryl group that may have a substituent, a cyano group, a nitro group, an alkoxy group, —$COOR_7$—, a halogenated carboxyl group, and $CONR_8R_9$; "$R_7$" in the —$COOR_7$— represents any one of a hydrogen atom, an alkyl group that may have a substituent, an aralkyl group that may have a substituent, and an aryl group that may have a substituent; "$R_8$" and "$R_9$" in the $CONR_8R_9$ represents any one of a hydrogen atom, a halogen atom, an alkyl group that may have a substituent, an aralkyl group that may have a substituent, and an aryl group that may have a substituent, and "$R_8$" and "$R_9$" may be the same or different from each other; "$Ar_1$" and "$Ar_2$" respectively represent a substituted or an unsubstituted allylene group, and may be the same or different from each other; "$Ar_3$" and "$Ar_4$" respectively represent a substituted or an unsubstituted aryl group, and may be the same or different from each other; "X" represents any one of a single bond, a substituted or an unsubstituted alkylene group, a substituted or an unsubstituted cycloalkylene group, a substituted or an unsubstituted alkylene ether group, an oxygen atom, a sulfur atom, and a vinylene group; "Z" represents any one of a substituted or an unsubstituted alkylene group, an unsubstituted alkylene ether divalent group, and an alkylene oxycarbonyl divalent group; and "m" and "n" are respectively an integer of 0 to 3.)

The proportion of the polyfunctional unsaturated carboxylic acid is 5% by mass to 75% by mass, preferably 10% by mass to 70% by mass and still more preferably 20% by mass to 60% by mass based on the total mass of the surface layer. When the proportion of the polyfunctional unsaturated carboxylic acid is less than 5% by mass, the mechanical strength of the surface layer is insufficient. When more than 75% by mass, a crack is likely to occur when a strong force is applied to the surface layer, and the photosensitivity tends to degrade.

When an acrylic resin is used for the surface layer of the photoconductor 3Y, the above-mentioned unsaturated carboxylic acid is applied on the surface of the photoconductor 3Y, thereafter, the surface of the photoconductor 3Y is irradiated with an electron beam or an active light beam such as an ultraviolet ray so as to be radically polymerized, thereby a surface layer can be formed. When the radical polymerization is carried out, a coating solution in which a photopolymerization initiator is dissolved in the unsaturated carboxylic acid is used. For the photopolymerization initiator, it is possible to use a material commonly used in photocurable coating compositions.

In order to enhance the mechanical strength of layers of the photoconductor 3Y, fine particles of metal or metal oxide may be dispersed in the surface layer. Examples of the metal oxide include tin oxides, potassium titanates, TiO, TiN, zinc oxides, indium oxides, and antimony oxides. Besides the above mentioned, for the purpose of improving the frictional resistance, a fluorine resin such as polytetrafluoroethylene; a silicone resin, a compound in which an inorganic material is dispersed in any of these resins, or the like can be added to the surface layer.

In FIG. 3, the developing device 4Y develops a latent electrostatic image using a two-component developer (simply, referred to as "developer" hereinbelow) containing a magnetic carrier (not shown) and a non-magnetic Y toner. The developing device 4Y has an agitation unit 5Y configured to agitate the developer housed inside thereof while conveying the developer and a developing unit 9Y configured to develop the latent electrostatic image on the photoconductor 3Y. Note that as the developing device 4Y, another type of developing device that develops a latent electrostatic image using a one-component developer containing no magnetic carrier may be used.

The agitation unit 5Y is mounted at a position lower than the developing unit 9Y and is equipped with a first conveyance screw 6Y and a second conveyance screw 7Y which are provided in parallel with each other, a partition board provided between these screws, and a toner concentration sensor 8Y provided at the bottom of a casing of the photoconductor 3Y.

The developing unit 9Y is equipped with a developer roller 10Y which is provided so as to face the photoconductor 3Y via an opening of the casing, and a doctor blade 13Y whose tip is made closely contact with the developing roller 10Y. The developing roller 10Y has a tubular developing sleeve 11Y made of a non-magnetic material, and a magnet roller 12Y unrotatably secured inside the developing sleeve 11Y. The magnet roller 12Y has a plurality of magnetic poles parallely arranged in the circumferential direction. These magnetic poles exert magnetic force on the developer on the developing sleeve 11Y at a predetermined position in the rotational direction. With this configuration, the developer sent from the agitation unit 5Y is attracted to the surface of the developing sleeve 11Y and is held thereon, and a magnetic brush along the magnetic field lines is formed on the surface of the developing sleeve 11Y.

The thickness of the magnetic brush is appropriately regulated when it passes through a position opposed to the surface of the doctor blade 13Y along with the rotation of the developing sleeve 11Y, and then the magnetic brush is conveyed to a developing area opposed to the surface of the photoconductor 3Y. Then, the magnetic brush makes Y toner transferred to the latent electrostatic image by means of a developing bias applied to the developing sleeve 11Y and an electric potential difference between the photoconductor 3Y and the latent electrostatic image, thereby contributing to the developing and forming a Y toner image. Further, magnetic brush is returned to the inside of the developing unit 9Y along with the ration of the developing sleeve 11Y, detached from the sleeve surface by the effect of a repulsive magnetic filed formed between the magnetic poles of the magnetic roller 12Y and then is returned to the inside of the agitation unit 5Y. The agitation unit 5Y is replenished with an appropriate amount of toner based on a result detected by the toner concentration sensor 8Y.

The developing bias applied to the developing sleeve 11Y has the same polarity as the normal charge polarity of Y toner and is composed of a direct current voltage of which the absolute value is lower than the absolute value of the potential at the background portion of the photoconductor 3Y and greater than the absolute value of the potential of the latent electrostatic image. With this configuration, a so-called "negative/positive developing" can be carried out.

The Y toner image formed on the surface of the photoconductor 3Y is transferred into a primary transfer nip for Y toner in accordance with the movement of the surface of the photoconductor 3Y. Specifically, a primary transfer roller 62Y makes contact with the back surface (inner circumferential face of the loop) of an endless intermediate transfer belt 61 so that the intermediate transfer belt 61 is pressed against the surface of the photoconductor 3Y, whereby the surface of the intermediate transfer belt 61 is contacted with the photoconductor 3Y to form the primary transfer nip for Y toner. To the primary transfer roller 62Y, a primary transfer bias with a negative polarity with respect to the normal charge polarity of Y toner is applied from a power source (not shown). By the application of the primary transfer bias, an electric field for transfer of Y toner image is generated at a gap between the latent electrostatic image on the photoconductor 3Y and the intermediate transfer belt 61. The Y toner image transferred into the primary transfer nip for Y toner along with the rotational driving of the photoconductor 3Y is primarily transferred from the photoconductor 3Y to the surface of the intermediate transfer belt 61 by the effects of the pressure applied to the nip and the electric field transfer.

A small amount of residual toner that is not primarily transferred to the intermediate transfer belt 61 adheres to the surface of the photoconductor 3Y that has passed the primary transfer nip for Y. The untransferred toner is removed from the surface of the photoconductor 3Y by the drum cleaning device 18Y.

As the drum cleaning device 18Y, a cleaning device designed to press a cleaning blade 20Y is pressed against the surface of the photoconductor 3Y is used. The drum cleaning device 18Y has the cleaning blade 20Y, a lubricant coater, a leveling blade 23Y and the like.

The surface of the photoconductor 3Y that has passed the primary transfer nip for Y toner along with the rotational drive thereof enters a position opposed to the drum cleaning device 18Y, and then sequentially passes through a position at which the surface is cleaned by the cleaning blade 20Y, a position at which a lubricant is applied by the lubricant coater and a position at which the applied lubricant is leveled.

Figure 4:
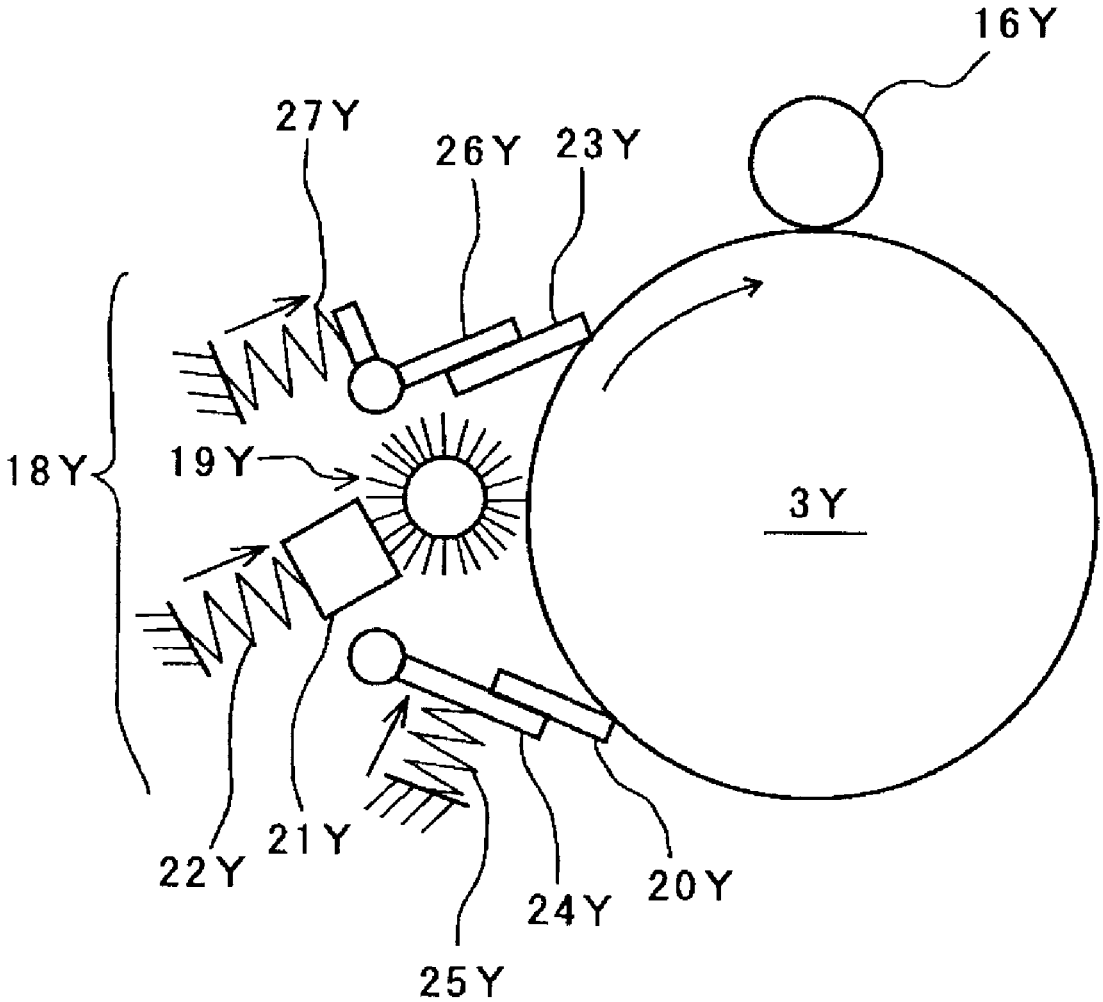
FIG. 4 is an enlarged structural view showing an internal structure of a drum cleaning device in the process unit shown in FIG. 3.

FIG. 4 is an enlarged structural view showing the internal structure of the drum cleaning device 18Y and the photoconductor 3Y. Note that FIG. 3 shows the photoconductor 3Y and the drum cleaning device 18Y from the opposite side of the drum-shaft line direction in the figure. The cleaning blade 20Y made of rubber, resin or the like is supported at one end edge thereof by a blade holder 24Y. Specifically, the blade holder 24Y is swingably supported in a state where an end edge opposed to the one end edge fixed to the cleaning blade 20Y is used as a rockshaft and is biased toward the surface of the photoconductor 3Y by a coil spring 25Y. With this configuration, the free end edge of the cleaning blade 20Y that is supported at the one end by the blade holder 24Y makes contact with the surface of the photoconductor 3Y. The residual toner adhering to the surface of the photoconductor 3Y is scraped out with the free end edge of the cleaning blade 20Y. Note that the cleaning blade 20Y is designed so as to make contact with the surface of the photoconductor 3Y in a so-called counter direction in which the free end edge of the cleaning blade 20Y is placed more upstream in the moving direction of the surface of the photoconductor 3Y than the fixed end edge.

The lubricant coater in the drum cleaning device 18Y has a coating brush roller 19Y, a solid lubricant 21Y biased toward the coating brush roller 19Y, a coil spring 22Y as a bias unit to bias the solid lubricant 21Y toward the coating brush roller 19Y, and the like. The lubricant coater also has a drive unit (not shown) that makes the coating brush roller 19Y driven to rotate in a clockwise direction in the figure. The coating brush roller 19Y is equipped with a rotation shaft member whose both ends in the longitudinal direction by a is rotatably supported by a shaft bearing (not shown), and a brush roller unit composed of a plurality of raised fiber filaments standing on the surface of the rotation shaft member. The coating brush roller 19Y is configured to apply an appropriate amount of a lubricant powder that has been scraped out from the solid lubricant 21Y to the surface of the photoconductor 3Y along with its rotation with a linear velocity difference between itself and the photoconductor 3Y while making the brush roller unit contact with both the solid lubricant 21Y and the surface of the photoconductor 3Y. By this application of lubricant, a lubricant film made of lubricant powder is formed on the surface of the photoconductor 3Y, adhesion between untransferred toner and the photoconductor 3Y is weakened, thereby improving the cleanability and protecting the photoconductor 3Y from electrostatic discharge energy generated at the time of uniformly charging the surface of the photoconductor 3Y.

The leveling blade 23Y in the drum cleaning device 18Y is, similarly to the cleaning blade 20Y, made of rubber, resin or the like and is supported at one end edge thereof by a blade holder 26Y. The blade holder 26Y is swingably supported in a state where an end edge opposed to the one end edge fixed to the leveling blade 23Y is used as a rockshaft and is biased toward the surface of the photoconductor 3Y by a coil spring 27Y. With this configuration, the free end edge of the leveling blade 23Y that is supported at the one end by the blade holder 26Y makes contact with the surface of the photoconductor 3Y. The leveling blade 23Y levels out the lubricant powder applied to the surface of the photoconductor 3Y by means of its free end edge, thereby a lubricant film is formed on the surface of the photoconductor 3Y. Note that the leveling blade 23Y is designed so as to make contact with the surface of the photoconductor 3Y in a so-called training direction in which the free end edge of the leveling blade 23Y is placed more downstream in the moving direction of the surface of the photoconductor 3Y than the fixed end edge.

The surface of the photoconductor 3Y that has passed a position at which the applied lubricant is leveled out by the drum cleaning device 18Y is subjected to a charge elimination by a charge elimination lamp (not shown), along with the rotational drive, is uniformly charged again by the electrostatic charge roller 16Y and then optically scanned by the above-mentioned optical writing unit.

In FIG. 2 explained above, an M toner image, a C toner image, and a K toner image are respectively formed on each of the surfaces of the photoconductors 3M, 3C, and 3K in the process units 2M, 2C, and 2K in the same course of steps as in the process unit 2Y for Y toner, which are described above.

On the downstream side of the four process units 2Y, 2M, 2C, and 2K, the transfer unit 60 is provided as a transfer means. This transfer unit 60 makes the intermediate transfer belt 61 which is spanned over a plurality of rollers contact with the photoconductors 3Y, 3M, 3C, and 3K and makes the intermediate transfer belt 61 move in an endless manner in a clockwise direction in the figure by the rotational driving of one of the rollers. With this configuration, the photoconductors 3Y, 3M, 3C and 3K can make contact with the surface of the intermediate transfer belt 61 to form primary transfer nips for Y, M, C and K.

In the vicinity of the primary transfer nips for Y, M, C and K, the intermediate transfer belt 61 is pressed against the photoconductors 3Y, 3M, 3C and 3K by each of the primary transfer rollers 62Y, 62M, 62C and 62K provided inside the loop of the intermediate transfer belt 61. To these primary transfer rollers 62Y, 62M, 62C and 62K, a primary transfer bias is applied from a power source (not shown). With this configuration, in each of the primary transfer nips for Y, M, C and K, a primary transfer electric field is formed so as to electrostatically transfer toner images on the photoconductors 3Y, 3M, 3C and 3K toward the intermediate transfer belt 61.

On the surface of the intermediate transfer belt 61 that passes through the primary transfer nips for Y, M, C and K sequentially in accordance with its endless movement in a clockwise direction in the figure, the toner images are sequentially overlaid at each of the primary transfer nips, and the overlaid toner image is primarily transferred. By the primary transfer, four-color overlaid toner images (referred to as "four-color toner images" hereinbelow) are formed on the surface of the intermediate transfer belt 61.

On the downstream side of the intermediate transfer belt 61 in the figure, a secondary transfer facing roller 72 is provided as an abutting member so as to make contact with the surface of the intermediate transfer belt 61 at a position where the intermediate transfer belt 61 is spanned to a secondary transfer roller 68 provided inside the intermediate transfer belt 61, whereby a secondary transfer nip is formed.

Inside the loop of the intermediate transfer belt 61, a secondary transfer bias with the same polarity as the normal charge polarity of toner (negative polarity in this example) is applied to the secondary transfer roller 68 serving as a transfer bias member via a secondary transfer power source circuit (not shown). In the meanwhile, the secondary transfer facing roller 72 which forms the secondary transfer nip while making contact with the surface of the intermediate transfer belt 61 is grounded. With this configuration, in the secondary transfer nip, a secondary transfer electric field is formed to electrostatically transfer the toner with negative polarity from the intermediate transfer belt 61 toward the secondary transfer facing roller 72.

On the right hand side of the secondary transfer nip in the figure, the above-mentioned pair of resist rollers (not shown) is provided, and a recording paper sheet sandwiched in between the rollers is sent to the secondary transfer nip at the timing when the recording paper sheet is synchronized with the four-color toner images on the surface of the intermediate transfer belt 61. In the secondary transfer nip, the four-color toner images on the intermediate transfer belt 61 are secondarily transferred onto the recording paper sheet at a time by effects of the secondary transfer electric field and the pressure applied to the nip to be a composite full-color image on the white color of the recording paper sheet.

To the surface of the intermediate transfer belt 61 that has passed through the secondary transfer nip, residual toner that has not been transferred at the secondary transfer nip to the recording paper sheet adheres. The residual toner is removed by a belt cleaning device 75 making contact with the intermediate transfer belt 61.

For the intermediate transfer belt 61, it is desirable to use a material that exhibits a volume resistivity of $10^5$ Ω·cm to $10^{11}$ Ω·cm. When the surface resistivity of the intermediate transfer belt 61 is lower than $10^5$ Ω·cm, it causes a phenomenon called "transfer duct" in which electrostatic discharge is generated between each of the photoconductors and the intermediate transfer belt 61 to disturb each of the toner images when the toner images are primarily transferred from each of the photoconductors to the intermediate transfer belt 61. When the surface resistivity is higher than $10^{11}$ Ω·cm, charge facing toner images remains on the surface of the intermediate transfer belt 61 that has passed through the secondary transfer nip, which may appear as an afterimage on the subsequent image.

As the intermediate transfer belt 61, a belt-shaped or cylindrical plastic or the like can be used which is formed by using, for example, a metal oxide such as tin oxide, and indium oxide; conductive particles such as carbon black; or a conductive polymer singularly or in combination, kneading the selected material with a thermoplastic resin, and extrusion-molding the kneaded mixture. Besides the above mentioned, it is possible to obtain an intermediate transfer belt in an endless belt form by adding the above-noted conductive particles and conductive polymer, if necessary, to a resin solution containing a thermally crosslinkable monomer and/or oligomer and centrifugal-molding the product under application of heat.

When a surface layer is formed on the surface of the intermediate transfer belt 61, it is possible to use a surface layer prepared by additionally using a conductive material in an appropriate amount with a composition containing the above-mentioned materials used in the surface layer of the photoconductor, but excluding charge transporting materials, so as to control the resistivity.

In FIG. 1 explained above, a recording paper P that has passed through the secondary transfer nip is away from the intermediate transfer belt 61 to be received by a conveyance belt unit 39. The conveyance belt unit 39 moves in an endless manner in a counterclockwise direction in the figure by the rotational drive of a drive roller while stretching an endless conveyance belt by the drive roller and a driven roller and then conveys the recording paper P received from the secondary transfer nip in accordance with its endless movement with the recording paper P being held on the upper stretching surface of the belt, and then transfers the recording paper P to the fixing unit 43.

The fixing unit 43 makes a fixing belt spanned by a drive roller and a heating roller incorporating a heat source move in an endless manner in a counterclockwise direction in the figure in accordance with the rotational driving of the drive roller. A pressurizing roller mounted at the downward portion of the fixing belt is abutted with the under span surface of the fixing belt to form a fixing nip. The recording paper P received by the fixing unit 43 is pressurized and heated in the fixing nip, whereby a full-color image is fixed on the surface of the recording paper P. Thereafter, the recording paper P is sent from the fixing unit 43 toward the pair of paper ejection rollers 47.

In a one-side print mode where an image is formed only on a first surface of the recording paper P, the recording paper P sandwiched in a paper ejection nip between the pair of paper ejection rollers 47 is directly ejected out of the apparatus and stacked on the output tray 48.

On the lower side of the fixing unit 43 and the conveyance belt unit 39, the switch back unit 46 is provided. In a both side print mode where an image is formed on both sides of the recording paper P, the recording paper P sandwiched in the paper ejection nip is returned in the reverse direction, transported to the switch back unit 46, flipped over in the switch back unit 46, is transported again to the secondary transfer nip, followed by image fixing on the backside of the recording paper P.

The scanner fixed on the printer section 1 has as document image reading units (not shown) a fixed reading unit and a movable reading unit. The fixed reading unit having a light source, a plurality of reflection mirrors, image reading sensors such as CCD is placed just below a first contact glass (not shown) fixed on the upper wall of the casing of the scanner 160 so as to make contact with a document. The document conveyed by the ADF 170 sequentially reflects light emitted from the light source at its document surface when being passed across the first contact glass, and reflected light is received by the image reading sensors via the plurality of reflection mirrors, thereby the document can be scanned without the necessity of moving optical systems composed of the light source, reflection mirrors, and so on.

Meanwhile, the movable reading unit of the scanner 160 is placed just below a second contact glass (not shown) fixed on the upper wall of the scanner 160 and enables optical systems composed of a light source, a plurality of reflection mirrors and so on to move in the horizontal direction in the figure. In the course of moving the optical systems from the left side to the right side in the figure, the movable reading unit makes light emitted from the light source by a document (not shown) put on the second contact glass, and reflected light is received by an image reading sensor fixed to the scanner main body via the plurality of reflection mirrors, thereby the document can be scanned while moving the optical systems.

As a toner used in developing, it is preferable to employ a toner having an average circularity of 0.93 to 1.00. The circularity can be calculated by the following equation:

(circularity *SR*=circumferential length of a circle having the same area as that of projected area of toner particle/circumferential length of projected image of toner particle)

The circularity is an index showing a degree of irregularities of toner particles. When a toner is formed in a perfect sphere, the circularity of the toner is 1.00. The more complicate the surface shape is, the lower the circularity becomes. When the average circularity is within the range of 0.93 to 1.00, the surface of toner particles is smooth and excellent transferability can be obtained because of the small contact area between toner particles and between each of toner particles and each of photoconductors. Further, the toner particles have no angles, and thus the agitation torque of the developer is reduced inside the developing device to stabilize the drive of agitation. Furthermore, there is no toner particles having angles present in a toner forming a dot, and thus when being pressed by the primary transfer nip and the secondary transfer nip, the pressure is evenly applied to the total of toner particles forming the dot. Therefore, a developing-void area hardly occurs. Further, toner particles per se have low grinding force because they do not have angles themselves. Therefore, surfaces of photoconductors are not damaged nor abraded away by the toner particles.

The circularity of the toner can be measured by a flow particle image analyzer, FPIA-1000 manufactured by SYSMEX Corp. Specifically, in a vessel, 100 mL to 150 mL of water from which impure solid materials have been previously removed is poured. To the water, 0.1 mL to 0.5 mL of a surfactant as a dispersing agent, preferably alkylbenzene sulfonate is added, and approximately 0.1 g to 0.5 g of a measurement sample (toner) is further added to yield a suspension. Next, the suspension is dispersed in a supersonic dispersing device for about 1 minute to 3 minutes so that the concentration of the dispersion liquid becomes 3,000/μL to 10,000/μL. The dispersion liquid is used as a test sample. The test sample is set in the flow particle image analyzer, and the shape, particle size and circularity of individual toner particles are measured. Then, the average of circularities of 100 toner particles is used as the average circularity.

It is desired to use a toner having a weight average particle diameter D4 of 3 μm to 10 μm. This is because within the above range, toner particles with sufficiently small particle diameters can be attached to each of microscopic latent image dots, and thus excellent dot reproductivity can be achieved. When the weight average particle diameter D4 is smaller than 3 μm, phenomena such as a reduction in transfer efficiency, degradation in blade cleanability and so on are likely to occur. When the weight average particle diameter D4 is larger than 10 μm, it is difficult to prevent ink-splattering in letters or characters and lines.

Further, it is desired to use a toner having a ratio (D4/D1) of a weight average particle diameter D4 to a number average particle diameter D1 of 1.00 to 1.40. The closer the ratio (D4/D1) is to 1, the sharper the particle size distribution of the toner is. When the ratio (D4/D1) is within the range of 1.00 to 1.40, above-mentioned phenomena caused depending on the toner particle size are not present, and thus excellent image stability can be achieved. Furthermore, the particle size distribution of the toner is sharp, and the frictional charge quantity distribution also becomes sharp, thereby capable of preventing toner fog. Besides, since toner particles have substantially uniform sizes, each of latent image dots can be developed with toner particles adhering to each of the dots such that toner particles are closely and orderly arranged. Thus, excellent dot reproductivity can be achieved with the toner.

The particle size distribution of toner can be measured by the coulter counter method. As to a device for measuring a particle size distribution of toner particles by the coulter counter method, COULTER COUNTER TA-II and COULTER MULTISIZER II (both manufactured by Coulter Co.) are exemplified. The method of measuring the particle size distribution is as follows. Firstly, in 100 mL to 150 mL of an electrolytic aqueous solution, 0.1 mL to 5 mL of surfactant (preferably, alkylbenzene sulfonate) is added. The electrolytic aqueous solution is an NaCL aqueous solution in which the proportion of primary sodium chloride is approximately 1%, and is available in the market. Examples thereof are ISOTON-II (available from Coulter Co.). After addition of the surfactant, 2 mg to 20 mg of a measurement sample is further added to the electrolytic aqueous solution. The electrolytic solution with the sample suspended therein is dispersed in a supersonic dispersing device for approximately 1 minute to 3 minutes. The dispersion liquid is set in the measurement device to measure the particle size of each of toner particles. At this stage, the volume of the toner or each of toner particle and the number of toner particles are measured with an aperture diameter of 100 μm, and a volume distribution and a number distribution are calculated. From the obtained distributions, the weight average particle diameter D4 and the number average particle diameter D1 can be determined. For channels used in the measurement device, the following 13 channels were used, and particles having a particle diameter of 2.00 μm to less than 40.30 μm were intended to be measured: a channel of 2.00 μm to less than 2.52 μm; a channel of 2.52 μm to less than 3.17 μm; a channel of 3.17 μm to less than 4.00 μm; a channel of 4.00 μm to less than 5.04 μm; a channel of 5.04 μm to less than 6.35 μm; a channel of 6.35 μm to less than 8.00 μm; a channel of 8.00 μm to less than 10.08 μm; a channel of 10.08 μm to less than 12.70 μm; a channel of 12.70 μm to less than 16.00 μm; a channel of 16.00 μm to less than 20.20 μm; a channel of 20.20 μm to less than 25.40 μm; a channel of 25.40 μm to less than 32.00 μm and a channel of 32.00 μm to less than 40.30 μm.

For a toner having substantially spherical shape as explained above, it is desired to use a toner prepared by subjecting a toner composition containing a polyester prepolymer having a functional group containing nitrogen atom, a polyester, a colorant, and a releasing promoter to a crosslinking and/or an elongation reaction in an aqueous medium in presence of resin fine particles. By hardening the surface of the toner that is produced by the reaction, it is possible to reduce hot offset and prevent contamination of a fixing unit used, thereby preventing images from being smeared.

As the prepolymer composed of a modified polyester resin, which is used as a base resin of the toner, polyester prepolymer (A) having an isocyanate group is exemplified. As a compound with which the prepolymer is subjected to an elongation or a crosslinking reaction, amines (B) are exemplified.

Examples of the polyester prepolymer (A) having an isocyanate group include a reaction product prepared by reacting polyester which is a polycondensate between polyol (a1) and polycarboxylic acid (a2) and having an active hydrogen group with polyisocyanate (a3). Examples of the active hydrogen group include hydroxyl groups (alcoholic hydroxyl groups and phenolic hydroxyl groups), amino groups, carboxyl groups, and mercapto groups. Of these, alcoholic hydroxyl groups are preferable.

Examples of the polyol (a1) include diols (a1-1) and trivalent or higher polyvalent polyols (a1-1). Diol (a1-1) may be singularly used, or a mixture between diol and a small amount of polyol (a1-2) may be used. Examples of the diol (a1-1) include alkylene glycols (ethylene glycol, 1,2-propylene glycol, 1,3-propylene glycol, 1,4-butanediol, and 1,6-hexanediol); alkylene ether glycols (diethylene glycol, triethylene glycol, dipropylene glycol, polyethylene glycol, polypropylene glycol, and polytetramethylene ether glycol); cycloaliphatic diols (1,4-cyclohexane dimethanol, hydrogenated bisphenol A, etc.); bisphenols (bisphenol A, bisphenol F, bisphenol S, etc.); alkylene oxide adducts of the above-noted alicyclic diols (ethylene oxide adducts, propylene oxide adducts, butylene oxide adducts, etc.); alkylene oxide adducts of the above-noted bisphenols (ethylene oxide adducts, propylene oxide adducts, and butylene oxide adducts). Of these, alkylene glycols having 2 to 12 carbon atoms, and alkylene oxide adducts of bisphenols are preferable. Particularly preferred are alkylene oxide adducts of bisphenols, and combinations between the alkylene oxide adducts of bisphenols and alkylene glycols having 2 to 12 carbon atoms. Examples of the trivalent or higher polyvalent polyol (a1-2) include trivalent to octavalent or higher polyvalent aliphatic alcohols (glycerine, trimethylolethane, trimethylolpropane, pentaerythritol, sorbitol, etc.); trivalent or higher polyvalent phenols (trisphenol PA, phenol novolac, cresol novolac, etc.); and alkylene oxide adducts of the trivalent or higher polyvalent polyphenols.

Examples of the polycarboxylic acid (a2) include dicarboxylic acid (a2-1) and trivalent or higher polyvalent polycarboxylic acid (a2-2). Dicarboxylic acid (a2-1) may be singularly used, or a mixture between dicarboxylic acid (a2-1) and a small amount of polycarboxylic acid (a2-2) may be used. Examples of the dicarboxylic acid (a2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalene dicarboxylic acid, etc.). Of these, alkenylene dicarboxylic acids having 4 to 20 carbon atoms, and aromatic dicarboxylic acids having 8 to 20 carbon atoms are preferable. Examples of the trivalent or higher polyvalent polycarboxylic acid (a2-2) include aromatic polycarboxylic acids having 9 to 20 carbon atoms (trimellitic acid, pyromellitic acid, etc.). Note that the polycarboxylic acid (a2) may be reacted with the polyol (a1) using any one of the acid anhydrides mentioned above or a lower alkyl ester (methyl ester, ethyl ester, isopropyl ester, etc.).

As to the mixture ratio of the polyol (a1) to the polycarboxylic acid (a2), it is desirable to adjust an equivalent ratio [OH]:[COOH] of a hydroxyl group [OH] to a carboxyl group [COOH] so as to be 2:1 to 1:1. The equivalent ratio is preferably 1.5:1 to 1:1, and still more preferably 1.3:1 to 1.02:1.

Examples of the polyisocyanate (a3) include aliphatic polyisocyanates (tetramethylenediisocyanate, hexamethylenediisocyanate, 2,6-diisocyanatemethylcaproate, etc.); alicyclic polyisocyanates (isophoroneisocyanate, cyclohexylmethane diisocyanate, etc.); aromatic diisocyanates (tolylenediisocyanate, diphenylmethanediisocyanate, etc.); aromatic aliphatic diisocyanates ($\alpha,\alpha,\alpha',\alpha'$-tetramethyl-xylylene diisocyanate, etc.); isocyanurates; polyisocyanates blocked with a phenol derivative, oxime, caprolactam or the like, and compounds prepared by using them in combination.

As to the mixture ratio of the polyisocyanate (a3), it is desirable to adjust an equivalent ratio [NCO]:[OH] of an isocyanate group [NCO] to a hydroxyl group in the polyester having a hydroxyl group [OH] so as to be 5:1 to 1:1. The equivalent ratio is preferably 4:1 to 1.2:1, and still more preferably 1.5:1 to 1.5:1. When the equivalent ratio [NCO]:[OH] is higher than 5, the low-temperature fixing property of the toner degrades. When the molar ratio of [NCO] is lower than 1, the amount of urea contained in the modified polyester is reduced and the anti-hot offset property of the toner degrades. The amount of the polyisocyanate (a3) components contained in the prepolymer having an isocyanate group at the terminals thereof is desirably 0.5% by mass to 40% by mass, more preferably 1% by mass to 30% by mass, and still more preferably 2% by mass to 20% by mass. When the amount is less than 0.5% by mass, the anti-hot offset property degrades, and it is disadvantageous in satisfying both heat resistance/storage stability and low-temperature fixing property. When the amount is more than 40% by mass, the low-temperature fixing property of the toner degrades.

The number of isocyanate groups contained in one molecule in the polyester prepolymer (A) having an isocyanate group is desirably 1 or more, more preferably 1.5 to 3 on the average, and still more preferably 1.8 to 2.5 on the average. When number of isocyanate groups per molecule is less than 1, the molecular mass of the urea-modified polyester is reduced, and the anti-hot offset property of the toner degrades.

Examples of the amines (B) include diamines (B1), trivalent or higher polyamines (B2), amino alcohols (B3), aminomercaptans (B4), amino acids (B5) and blocked amines of which amino groups of B1 to B5 are blocked (B6). Examples of the diamines (B1) include aromatic diamines (such as phenylene diamine, diethyl toluene diamine, and 4,4'-diaminodiphenylmethane); cycloaliphatic diamines (such as 4,4'-diamino-3,3'-dimethyldicyclohexylmethane, diamine cyclohexane, and isophorone diamine); and aliphatic amines (such as ethylene diamine, tetramethylene diamine, and hexamethylene diamine).

Examples of the trivalent or higher polyamines (B2) include diethylene triamine and triethylene tetramine. Examples of the amino alcohols (B3) include ethanol amine and hydroxyethyl aniline. Examples of the aminomercaptans (B4) include aminoethyl mercaptan and aminopropyl mercaptan. Examples of the amino acids (B5) include amino propionate and amino caproate. Examples of the blocked amines of which amino groups of B1 to B5 are blocked (B6) include ketimine compounds obtainable from the amines of B1 to B5 and ketones (such as acetone, methylethylketone, and methylisobutylketone), and oxazolidine compounds. Of these amines (B), B1 and mixtures of B1 with a small amount of amine B2 are preferable.

The molecular mass of the urea-modified polyester can be controlled using an elongation stopper in accordance with the necessity. Examples of the elongation stopper include monoamines (such as diethylamine, dibutylamine, butylamine, and laurylamine), and blocked amines in which these amines are blocked (ketimine compounds).

As to the mixture ratio of the amines (B), it is desired to adjust the equivalent ratio of [NCO]/[NHx] of isocyanate group [NCO] contained in the polyester prepolymer (A) having an isocyanate group to amino group [NHx] contained in the amines (B) so as to be 1:2 to 2:1. The equivalent ratio of [NCO]/[NHx] is more preferably 1.5:1 to 1:1.5, and still more preferably 1.2:1 to 1:1.2. When the equivalent ratio of [NCO]/[NHx] is higher than 2 or lower than ½, the molecular mass of the urea-modified polyester is reduced, and the anti-hot offset property of the toner degrades. In the polyester modified with urea bonds, a urethane bond may be contained together with the urea bonds. The molar ratio of the urea bond content to the urethane bond content is desirably 100:0 to 10:90, more preferably 80:20 to 20:80, and still more preferably 60:40 to 30:70. When the molar ratio of urea bond is less than 10%, the anti-hot offset property degrades.

As described above, a urea-modified polyester can be prepared in a modified polyester. The urea-modified polyester is produced by a one-shot method, a prepolymer method, or the like. The weight average molecular mass of the urea-modified polyester is preferably 10,000 or more, more preferably 20,000 to 10,000,000, and still more preferably 30,000 to 1,000,000. When the weight average molecular mass is less than 10,000, the anti-hot offset property of the toner degrades. When an unmodified polyester (ii), which will be described later, is used, the number average molecular mass of the urea-modified polyester is not particularly limited, and it may be the number average molecular mass by which the above-noted weight average molecular mass is readily obtained. When the urea-modified polyester is singularly used, the number average molecular mass of the urea-modified polyester is preferably 20,000 or less, more preferably 1,000 to 10,000, and still more preferably 2,000 to 8,000. When the number average molecular mass is more than 20,000, the low-temperature fixing property, and the glossiness at the time of using the toner in a full-color image forming apparatus degrade.

Not singularly using the polyester modified with urea bonds, the polyester can be mixed with an unmodified polyester as binder resin components. Since the glossiness of the toner at the time of using it in a full-color image forming apparatus can be improved by additionally using an unmodified polyester, this is preferred to the case a polyester modified with urea bonds is singularly used. Examples of the unmodified polyester include a polycondensation between the polyol (a1) and the polycarboxylic acid (a2), which has similar components to those of the polyester modified with urea bonds. Preferred examples of the unmodified polyester are also similar to those of the polyester modified with urea bonds. Further, for the unmodified polyester, not only unmodified polyesters but also polyesters modified with chemical bonds other than urea bonds can be used. For example, it may be modified with a urethane bond. It is preferable, from the perspective of low-temperature fixing property and anti-hot offset property, that at least part of the polyester modified with urea bonds be compatible with part of the polyester not modified with urea bonds. Thus, for the polyester not modified with urea bonds, it is preferable to use a polyester having a similar composition to the components of the polyester modified with urea bonds. In the case where the polyester not modified with urea bonds is contained, the mass ratio of the polyester modified with urea bonds to the polyester not modified with urea bonds is preferably 5:95 to 80:20, more preferably 5:95 to 30:70, still more preferably 5:95 to 25:75, and particularly preferably 7:93 to 20:80. When the mass ratio of the polyester modified with urea bonds is less than 5%, the anti-hot offset property of the toner degrades, and it is disadvantageous in satisfying both to heat resistance/storage stability and low-temperature fixing property.

The peak molecular mass of the polyester not modified with urea bonds is preferably 1,000 to 30,000, more preferably 1,500 to 10,000, and still more preferably 2,000 to 8,000. When the peak molecular mass is less than 1,000, the heat resistance/storage stability of the toner degrades, and when more than 10,000, the low-temperature fixing property degrades. The hydroxyl group valence of the polyester not modified with urea bonds is preferably 5 or more, still more preferably 10 to 120, and particularly preferably 20 to 80. When the hydroxyl group valence is less than 5, it is disadvantageous in satisfying both heat resistance/storage stability and low-temperature fixing property. The acid value of the polyester not modified with urea bonds is preferably 1 to 30, and more preferably 5 to 20. When a toner has an acid value, the toner tends to have negative charge polarity.

The glass transition temperature (Tg) of the binder resin contained in the toner is preferably 50° C. to 70° C., and more preferably 55° C. to 65° C. When the glass transition temperature (Tg) is lower than 50° C., blocking tends to occur when the toner is stored at high-temperature, and when higher than 70° C., the low-temperature fixing property becomes insufficient. By making a polyester not modified with urea bonds coexist with a urea modified polyester resin in toner, there is a tendency that the toner will exhibit favorable heat resistance/storage stability, even though the glass transition temperature (Tg) is low. As for storage elastic modulus of the binder resin, the glass transition temperature (Tg) at which the storage elastic modulus of the binder resin is 10,000 [dyne/cm$^2$] at a frequency of 20 Hz is preferably 100° C. or higher, and more preferably 110° C. to 200° C. When the temperature (Tg) is lower than 100° C., the anti-hot offset property degrades. As for the viscosity of the binder resin, the temperature (Tη) at which the viscosity of the binder resin becomes 1,000 poises is preferably 180° C. or lower, and more preferably 90° C. to 160° C. When the temperature (Tη) is higher than 180° C., the low-temperature fixing property degrades. Therefore, from the viewpoint of satisfying both low-temperature fixing property and anti-hot offset property, it is preferable that the Tg be higher than the Tη. In other words, a difference of the Tg minus the Tη(Tg−Tη) is preferably 0° C. or more, more preferably 10° C. or more, and particularly preferably 20° C. or more. The upper limit of the difference is not restricted. More specifically, from the viewpoint of satisfying both heat resistance/storage stability and low-temperature fixing property, the difference of the Tg minus the Tη (Tg−Tη) is preferably 0° C. to 100° C., more preferably 10° C. to 90° C., and particularly preferably 20° C. to 80° C.

The binder resin can be produced by a method to be explained below. Specifically, polyol (a1) and polycarboxylic acid (a2) are heated at 150° C. to 280° C. in presence of a known esterified catalyst such as tetrabutoxy titanate, and dibutyltin oxide, and water is distilled away with reducing the pressure if necessary to thereby obtain a polyester containing a hydroxyl group. Next, polyisocyanate (a3) is reacted at 40° C. to 140° C. to obtain a polyester prepolymer (A) having an isocyanate group. The polyester prepolymer (A) is reacted with amines (B) at 0° C. to 140° C. to thereby obtain a polyester modified with urea bonds. When the polyisocyanate (a3) is reacted, and when the polyester prepolymer (A) is reacted with the amines (B), a solvent(s) may be used in accordance with the necessity. Examples of usable solvents include aromatic solvents (toluene, xylene, etc.); ketones (acetone, methylethylketone, methylisobutylketone, etc.); esters (ethyl acetate, etc.); amides (dimethylformamide, dimethylacetoamide, etc.); and solvents inactive to polyisocyanates (a3) such as ethers (tetrahydrofuran, etc.). When a polyester not modified with urea bonds is additionally used, firstly, the polyester not modified with urea bonds is produced by a method similar to the method for producing the polyester having a hydroxyl group, and then this polyester is dissolved and mixed in a solution obtained after completion of the reaction of the polyester modified with urea bonds. Note that the method for producing a toner is not limited to the method explained hereinabove.

A aqueous medium used in producing the toner, water may be singularly used, or a solvent miscible in water may be used in combination with water. Examples of the solvent miscible in water include alcohols (methanol, isopropanol, ethylene glycol, etc.), dimethylformamide, tetrahydrofuran, cellosolves (methyl cellosolve, etc.) and lower ketones (acetone, methylethylketone, etc.).

Tone particles may be formed by reacting a dispersion composed of a polyester prepolymer (A) having an isocyanate group with amines (B) in an aqueous medium, or a urea-modified polyester that has been preliminarily prepared may be used. As the method of stably forming the dispersion by reacting the urea-modified polyester with the polyester prepolymer (A) in an aqueous medium, a method is exemplified in which a toner material composition composed of the urea-modified polyester and the polyester prepolymer (A) is added to an aqueous medium, and the dispersion is dispersed by a shearing force. The polyester prepolymer (A) and the other toner composition (referred to as "toner materials" hereinafter) composed of a colorant, a colorant masterbatch, a releasing promoter, a charge controlling agent, an unmodified polyester resin and the like may be mixed together with the dispersion in an aqueous medium, but it is preferable that the toner materials be mixed beforehand and the mixture be added to and dispersed in the aqueous medium. The other toner materials such as a colorant, a releasing promoter, and a charge controlling agent are not necessarily mixed when particles are formed in the aqueous medium, and such materials may be added after forming particles. For example, after forming particles containing no colorant, a colorant can be added by a conventionally known staining method.

The dispersing method is not particularly limited and may be suitably selected from among conventionally known methods such as low-speed shearing mode, high-speed shearing mode, frictional mode, high-pressure jet mode, and supersonic mode. In order to make the dispersion have a particle size of 2 μm to 20 μm, it is preferable to employ a high-speed shearing mode. When a high-speed shearing dispersing device is used, the number of revolutions is preferably 1,000 rpm to 30,000 rpm, and more preferably 5,000 rpm to 20,000 rmp. The dispersion time is not particularly limited, but when a batch mode is employed, it is approximately 0.1 minutes to 5 minutes. The temperature of the system during the dispersion is preferably 0° C. to 150° C. (under pressurization) and more preferably 40° C. to 98° C. Within the temperature range, a higher temperature is preferable in that the viscosity of the dispersion composed of the urea-modified polyester and the polyester prepolymer (A) can be made lower, thereby making it possible to easily disperse the toner material in an aqueous medium.

The use amount of the aqueous medium is preferably 50 parts by mass to 2,000 parts by mass, more preferably 100 parts by mass to 1,000 parts by mass based on 100 parts by mass of the toner composition containing the urea-modified polyester and the polyester prepolymer (A). When the use amount of the aqueous medium is less than 50 parts by mass, toner particles with predetermined particle sizes cannot be obtained. When the use amount is more than 20,000 parts by mass, it is economically disadvantageous. Further, a dispersing agent may be used in accordance with the necessity. It is preferable to use a dispersing agent in that the particle size distribution becomes sharp and the dispersed state is stable.

In the step where a urea-modified polyester is synthesized from the polyester prepolymer (A), amines (B) may be added before the toner composition is dispersed in an aqueous medium, or after dispersing the toner composition in the aqueous medium, amines (B) may be added to induce a reaction from the interface of particles. In this case, it is possible to preferentially generate a urea-modified polyester on the surface of toner particles and generate a concentration gradient inside the toner particles.

Examples of the dispersing agent used for emulsifying and dispersing an oil phase with the toner composition dispersed therein in a liquid containing water include anionic surfactants such as alkylbenzene sulfonate, α-olefin sulfonate, and phosphoric ester; and amine salts such as alkyl amine salts, amino alcohol fatty acid derivatives, polyamine fatty acid derivatives, and imidazoline. Besides the above-mentioned, the dispersing agent may be a cationic surfactant of quaternary ammonium salt type such as alkyltrimethyl ammonium salt, dialkyldimethyl ammonium salt, alkyldimethylbenzylammonium salt, pyridinium salt, alkylisoquinolium salt, and chlorinated benzethonium; a nonionic surfactant such as fatty acid amide derivatives, polyhydric alcohol derivatives; or an amphoteric surfactant such as alanine, dodecyldi(aminoethyl)glycine, di(octylaminoethyl)glycine, and N-alkyl-N,N-dimethylammoniumbetaine.

The effect can be improved with the use of a very small amount of a surfactant having a fluoroalkyl group. Preferred examples of an anionic surfactant having a fluoroalkyl group include fluoroalkyl carboxylic acids having 2 to 10 carbon atoms, metal salts thereof, perfluorooctane sulfonyl disodium glutamate, 3-[omega-fluoroalkyl (C6 to C11)oxy]-1-alkyl (C3 to C4) sodium sulfonate, 3-[omega-fluoroalkanoyl (C6 to C8)-N-ethylamino]-1-propane sodium sulfonate, fluoroalkyl carboxylic acids (C11 to C20) and metal salts thereof, perfluoroalkyl carboxylic acids (C7 to C13) and metal salts thereof, perfluoroalkyl sulfonate (C4 to C12) and metal salts thereof, perfluorooctane sulfonate dimethanol amide, N-propyl-N-(2-hydoxyethyl)perfluorooctane sulfone amide, perfluoroalkyl (C6 to C10) sulfone amide propyl trimethylammonium salts, perfluoroalkyl (C6 to C10)-N-ethylsulfonyl glycine salts, and monoperfluoroalkyl (C6 to C16) ethyl phosphoric ester. Examples of such commercially available products are SURFLON S-111, S-112, and S-113 (manufactured by Asahi Glass Co.); FRORARD FC-93, FC-95, FC-98, and FC-129 (manufactured by Sumitomo 3M Ltd.), UNIDYNE DS-101, and DS-102 (manufactured by Daikin Industries, Ltd.), MEGAFAC F-110, F-120, F-113, F-191, F-812, and F-833 (manufactured by Dainippon Ink and Chemicals, Inc.); ECTOP EF-102, 103, 104, 105, 112, 123A, 123B, 306A, 501, 201, and 204 (manufactured by Tohchem Products Co.); and FUTARGENT F-100, and F150 (manufactured by Neos Co.).

Examples of the cationic surfactants include primary fatty acids having a fluoroalkyl group, secondary or tertiary amine acids, quaternary ammonium salts of fatty acids such as perfluoroalkyl (C6 to C10) sulfone amide propyltrimethyl ammonium salts, benzalkonium salts, benzethonium chloride, pyridinium salts, and imidazolinium salts. Examples of commercially available products of the cationic surfactants are SURFLON S-121 (manufactured by Asahi Glass Co.), FRORARD FC-135 (manufactured by Sumitomo 3M Ltd.); UNIDYNE DS-202 (manufactured by Daikin Industries, Ltd.); MEGAFAC F-150, and F-824 (manufactured by Dainippon Ink and Chemicals, Inc.); ECTOP EF-132 (manufactured by Tohchem Products Co.); and FUTARGENT F-300 (manufactured by Neos Co.).

As a dispersing agent composed of an inorganic compound hardly soluble in water, tricalcium phosphate, calcium carbonate, titanium oxide, colloidal silica, or hydroxy apatite may be used. Alternatively, dispersion liquid droplets may be stabilized with the use of a polymeric protective colloid. Examples of such dispersing agent include acids such as acrylic acid, methacrylic acid, α-cyano-acrylate, α-cyano-methacrylate, itaconic acid, crotonic acid, fumaric acid, maleic acid, and maleic anhydride; or (meth)acrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerine monoacrylic ester, glycerine monomethacrylic ester, and N-methylol acrylamide, N-methylol methacrylamide; vinyl alcohols or ethers of vinyl alcohols such as vinylmethyl ether, vinylethyl ether, and vinylpropyl ether; esters of compounds containing vinyl alcohol and a carboxyl group such as vinyl acetate, vinyl propionate, and vinyl butylate; acrylamide, methacrylamide, diacetone acrylamide or methylol compounds thereof; acid chlorides such as acrylic chlorides, and methacrylic chloride; nitrogen atoms of vinyl pyridine, vinyl pyrolidone, vinyl imidazole, and ethylene imine, or homopolymers or copolymers having a heterocyclic ring thereof, polyoxyethylene, or polyoxyethylene-based compounds such as polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene lauryl phenyl ether, polyoxyethylene stearyl phenyl ester, and polyoxyethylene nonylphenyl ester; and celluloses such as methyl cellulose, hydroxyethyl cellulose, and hydroxy propyl cellulose.

When a dispersion stabilizer that is soluble in acid or alkali such as calcium phosphate salt is used, the calcium phosphate salt is removed from fine particles produced by washing with water. Besides, the calcium phosphate salt can also be removed by enzyme decomposition.

When a dispersing agent is used, the dispersing agent can be left intact on the surface of toner particles, but it is preferable to remove the dispersing agent with washing after elongation and/or crosslinking reaction.

To lower the viscosity of the toner composition, it is also possible to use a solvent capable of dissolving the urea-modified polyester and the polyester prepolymer (A). It is preferable to use a solvent in that the particle size distribution of toner particles can be made sharp. In terms of easy removal, it is preferable that the solvent be volatile. Examples of such solvent include toluene, xylene, benzene, carbon tetrachloride, chlorinated methylene, 1,2-dichloroethane, 1,1,2-trichloroethane, trichloroethylene, chloroform, monochlorobenzene, dichloroethylidene, methyl acetate, ethyl acetate, methylethylketone, and methylisobutyl ketone. These solvents may be used alone or in combination. Of these, aromatic solvents such as toluene and xylene, or halogenated hydrocarbons such as 1,2-dichloroethane, chloroform, and carbon tetrachloride are preferable. Among these, aromatic solvents such as toluene and xylene are more preferable. The use amount of the solvent is preferably 0 parts by mass to 300 parts by mass, more preferably 0 parts by mass to 100 parts by mass, and still more preferably 25 parts by mass to 70 parts by mass based on 100 parts by mass of the polyester prepolymer (A). When a solvent is used, the solvent is removed from the system that has been subjected to an elongation and/or crosslinking reaction, under normal pressure or reduced pressure.

The elongation reaction time, the crosslinking reaction time or the elongation-crosslinking reaction will be suitably set in accordance with the reactivity of a combination between the isocyanate group structure contained in the polyester prepolymer (A) and amines (B) used. The reaction time is usually 10 minutes to 40 hours, and preferably 2 hours to 24 hours. The reaction temperature is usually 0° C. to 150° C., and more preferably 40° C. to 98° C. Further, a known catalyst can be used in accordance with the necessity. Specific examples thereof include dibutyltin laurate and dioctyltin laurate.

In order to remove an organic solvent from the obtained emulsified dispersion, it is possible to employ a method in which the temperature of the entire system is gradually increased, and the organic solvent in liquid droplets is completely removed by evaporation. Alternatively, after atomizing the emulsified dispersion in a dry atmosphere, a non-aqueous organic solvent in liquid droplets can be completely removed to form toner fine particles, and simultaneously an aqueous dispersing agent can be removed therefrom. As the dry atmosphere in which the emulsified dispersion is atomized, a heated gas obtained by heating air, nitrogen, carbon dioxide or combustion gas is used. Particularly, various types of airstreams heated at a temperature higher than the boiling point of a solvent used are generally used. An intended quality of toner fine particles can be obtained by heating with a spray dryer, belt dryer or in a rotary kiln in a short time.

When the particle size distribution is made widened in the emulsification-dispersion process, and the system is washed and dried with keeping the particle size distribution, and the particle size distribution can be controlled so as to be a desired particle size distribution in a classification process.

The classification can be carried out by removing fine particles using, for example, a cyclone, a decanter, a centrifugal separator or the like. A powder obtained after the emulsified dispersion being dried may be subjected to a classification process, however, it is preferable, in terms of efficiency, to perform the classification process in a liquid. Obtained unnecessary fine particles or coarse particles can be returned again to a kneading process for use in formation of particles. At that time, the fine particles or coarse particles can be in a wet state.

It is preferable that used dispersing agent be removed from the obtained dispersion liquid as much as possible. The removal of used dispersing agent is preferably carried out in parallel with the classification process.

By mixing the obtained dried toner powder with different types of particles such as releasing promoter fine particles, charge controllable fine particles, fluidizer fine particles and colorant fine particles, or by applying a mechanical impulse force to the mixed powder, and by solidifying and combining these fine particles on the surface of toner particles, it is possible to prevent for the different types of particles from desorbing from the surface of obtained composite particles. Specifically, a method of applying an impulse force to the mixture by means of rotatable blades with high speed, and a method in which a mixture is put in an air stream, the mixture flowing in the airflow is speeded up, and particles are collide with a suitable collision plate or making particles collide with each other in a jet stream. As for a device used in such a process, ANGMILL (manufactured by Hosokawa micron Co., Ltd.), a device of which an I-type mill (manufactured by Nippon Pneumatic Manufacturing Co., Ltd.) is remodeled so as to reduce pulverization air pressure, hybridization system (manufactured by Nara Kikai Seisakusho K.K.), KRIPTON SYSTEM (manufactured by Kawasaki Heavy Industries, Ltd.), and an automatic mortar are exemplified.

For a colorant used in the toner, pigments and dyes conventionally used as colorants for toner can be used. Examples thereof include carbon black, lamp black, iron black, ultramarine, nigrosine dye, aniline blue, phthalocyanine blue, phthalocyanine green, Hansa yellow G, rhodamine 6C lake, Calconyl Blue, chrome yellow, quinacridone red, benzidine yellow, and Rose Bengale. These pigments and dyes may be used alone or in combination.

To make toner particles per se have magnetic properties in accordance with the necessity, all that is required to use singularly or mix magnetic components of iron oxides such as ferrite, magnetite, maghemite; metals such as iron, cobalt, and nickel or metal alloys between these metals and other metals and contain in toner particles. These components may be used as colorant components or additionally used.

The number average diameter of a colorant in the toner is preferably 0.5 μm or less, more preferably 0.4 μm or less, and still more preferably 0.3 μm or less.

When the number average diameter of a colorant in the toner is greater than 0.5 μm, the dispersibility of the pigment is on an insufficient level, and suitable transparency may not obtained. A colorant of smaller in particle size than 0.1 μm is much smaller than one-half wavelength of visible light, and thus it is considered that such a colorant does not adversely affect reflection of light and light absorption properties. Therefore, colorant particles of less than 0.1 μm in diameter contribute to excellent color-reproductivity and the transparency of OHP sheets with an image fixed on a surface thereof. On the other hand, when a large amount of a colorant having a particle diameter greater than 0.5 μm is present, transmission of incident light is blocked and/or incident light is scattered, and the brightness and color of a projected image on an OHP sheet tends to degrade. Further, when a large amount of a colorant having a particle diameter greater than 0.5 μm is present, the colorant is detached from the surface of toner particles, easily causing various problems such as fog, contamination of drum, and defective cleaning, inconveniently. Particularly, the amount of a colorant of greater than 0.7 μm in particle diameter is preferably 10% by number or less and more preferably 5% by number or less to the total amount of colorants used.

It is preferred that a binder resin and a colorant be sufficiently combined at an initial stage by preliminarily adding the colorant in a wetting liquid together with part or the entire of the binder resin and kneading the materials. With this preparation, thereafter, the colorant can be more efficiently dispersed in toner particles in the subsequent toner production process. The reason for this is that the dispersion particle size of the colorant becomes smaller, further excellent transparency can be obtained.

For the binder resin used in the preliminary kneading process, the resins exemplified as binder resins for toner can be used, but it is not limited thereto.

As a method of preliminarily kneading a mixture of the binder resin and the colorant with the wetting liquid, a method is exemplified in which the binder resin, the colorant and the wetting liquid are mixed with a blender such as HENSCHEL MIXER, the obtained mixture is kneaded at a temperature lower than the melting point of the binder resin by a kneader such as a twin-roll mill and a triple roll mill, thereby obtaining a sample.

As the wetting liquid, a commonly used wetting liquid can be used in consideration of the solubility of the binder resin and the wetting property to the colorant. Particularly, organic solvents such as acetone, toluene, and butanone; and water are preferable from the perspective of the dispersibility of the colorant. Among these, the use of water is further preferable from the perspective of attention to environments and maintaining the dispersion stability of the colorant in the subsequent toner production process. According to this method, it is advantageous in that not only the particle size of colorant particles contained in the produced toner can be made small, but also the uniformity of the dispersed state of the colorant particles is improved, and thus the color-reproductivity of projected image formed on OHP sheets is further improved. A releasing promoter typified by wax can be added in the toner, along with the binder resin and colorant.

For the releasing promoter, a conventionally known releasing promoter can be used. Examples thereof include polyolefine waxes (polyethylene wax, polypropylene wax, etc.); long chain hydrocarbons (paraffin wax, sazole wax, etc.); and carbonyl group-containing waxes. Of these, carbonyl group-containing waxes are preferable. Examples of the carbonyl group-containing waxes include polyalkanoic esters (carnauba wax, montan wax, trimethylol propane tribehenate, pentaerythritol tetrabehenate, pentaerythritol diacetate behenate, glycerine tribehenate, 1,18-octadecandioldistearate, etc.); polyalkanol esters (trimellitic tristearyl, distearyl maleate, etc.); polyalkanoic amides (ethylenediamine dibehenylamide, etc.); and polyalkylamides (distearylketone, etc.). Of these carbonyl group-containing waxes, polyalkanoic esters are preferable. The melting point of these releasing agents is 40° C. to 160° C., preferably 50° C. to 120° C., and still more preferably 60° C. to 90° C. A wax having a melting point of lower than 40° C. adversely affects the heat resistance/storage stability of the toner, and a wax having a melting point of higher than 160° C. is likely to cause cold-offset at the time of fixing. The melt viscosity of the wax is preferably 5 cps to 1,000 cps, and still more preferably 10 cps to 100 cps, as a value measured at a temperature 20° C. higher than the melting point of the wax. A wax having a melt viscosity higher than 1,000 cps has less effects of improving the anti-hot offset property and low-temperature fixing property. The amount of the wax contained in the toner is usually 0% by mass to 40% by mass, and preferably 3% by mass to 30% by mass.

To accelerate a charged amount of toner and the initial rise thereof, a charge controlling agent may be added in the toner in accordance with the necessity. When a colored charge controlling agent is used at that time, the color of toner is changed, and thus a charge controlling agent of colorless or with a color close to white is preferably used. For the charge controlling agent, a conventionally known charge controlling agent can be used. Examples thereof include triphenylmethane dyes, molybdenum chelate pigments, rhodamine dyes, alkoxy amines, quaternary ammonium salts (including fluorine-modified quaternary ammonium salts), alkylamide, phosphorous monomers and compounds, tungsten monomers and compounds, fluorine activators, salicylic metal salts, and metal salts of salicylate derivatives. Specific examples thereof include BONTRON P-51 composed of quaternary ammonium salt, E-82 composed on oxynaphthoic metal complex, E-84 composed of salicylic metal complex, and E-89 composed of phenol condensate (all manufactured by Orient Chemical Industries, Ltd.); TP-302 and TP-415 each composed of molybdenum complex of quaternary ammonium salt (all manufactured by Hodogaya Chemical Co.); COPY CHARGE PSY VP2038 composed of quaternary ammonium salt, COPY BLUE PR composed of triphenyl methane derivative, COPY CHARGE NEG VP2036 and COPY CHARGE NEX VP434 each composed of quaternary ammonium salt (all manufactured by Hochst Corporation); LRA-901, and LR-147 (boron complex) (all manufactured by Japan Carlit Co., Ltd.); quinacridone, azo pigments; and polymer based compounds having a functional group such as sulfonic acid group, carboxyl group, and quaternary ammonium salt.

The use amount of the charge controlling agent is determined in view of the type of the binder resin, the presence or absence of additives used in accordance with the necessity and the toner production method including the dispersing method, and cannot be unequivocally defined, however, the charge controlling agent is used within the range of approximately 0.1 parts by mass to 10 parts by mass based on 100 parts by mass of the binder resin. More preferably, it is used within the range of 0.2 parts by mass to 5 parts by mass. When the use amount of the charge controlling agent is more than 10 parts by mass, the effect of the main charge controlling agent is reduced due to an excessive charged amount of the toner, the electrostatic attraction force is increased to the developing roller used, causing a degradation in flowability of the developer and a reduction in image density. These charge controlling agents may be melted and kneaded along with a masterbatch and resins and then dissolved and dispersed, or may be added when the toner material is directly dissolved and dispersed in an organic solvent, or may be solidified on the surface of toner after forming toner particles. Further, in the course of toner production, resin fine particles for mainly stabilizing a dispersed state may be added at the time when the toner composition is dispersed in an aqueous medium.

Any resin fine particles may be used as long as capable of forming an aqueous dispersion, and may be a thermoplastic resin or a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins may be used in combination. Of these resins, vinyl resins, polyurethane resins, epoxy resins, polyester resins and combinations thereof are preferable.

Examples of the vinyl resins include polymers prepared by polymerization of a vinyl monomer or by copolymerization of vinyl monomers. For example, styrene-(meth)acrylic ester resins, styrene-butadiene copolymers, (meth)acrylic-acrylic ester polymers, styrene-acrylonitrile copolymers, styrene-maleic anhydride copolymers, and styrene-(meth)acrylic acid copolymers are exemplified, however, the vinyl resins are not limited thereto.

As external additives for supplementing flowability, developing property and charge property, it is preferable to use inorganic fine particles. The primary particle diameter of the inorganic fine particles is preferably 5 nm to 2 μm, and particularly preferably 5 nm to 500 nm. The specific surface area of the inorganic fine particles, measured by the BET method, is preferably 20 $m^2/g$ to 500 $m^2/g$. The proportion of the inorganic fine particles used is preferably 0.01% by mass to 5% by mass and particularly preferably 0.01% by mass to 2.0% by mass in relation to the toner. Examples of the inorganic fine particles include silica, alumina, titanium oxide, barium titanate, magnesium titanate, calcium titanate, strontium titanate, zinc oxide, tin oxide, silica sand, clay, mica, wallastonite, silious earth, chromium oxide, cerium oxide, colcothar, antimony trioxide, magnesium oxide, zirconium oxide, barium sulfate, barium carbonate, calcium carbonate, silicon carbide, and silicon nitride. Besides the above mentioned, polymer-based fine particles, for example, polystyrenes, methacrylic ester copolymers and acrylic ester copolymers obtained by soap-free emulsification polymerization and suspension polymerization or dispersion polymerization; polycondensation products such as silicone, benzoguanamine, and nylon; and polymer particles prepared with thermosetting resins are exemplified.

These inorganic fine particles are capable of improving the hydrophobicity of toner particles and preventing degradations in flowability and charge properties of toner particles even under high-humidity environments. Preferred examples of surface treatment agents include silane coupling agents, silylation agents, silane coupling agents having an alkyl fluoride group, organic titanate coupling agents, aluminum coupling agents, silicone oils and modified silicone oils.

Examples of cleanability improver used to remove untransferred toner remaining on the surfaces of photoconductors and the surface of the intermediate transfer belt 61 include fatty acid metal salts of zinc stearates, calcium stearates, stearic acids and the like; and polymer fine particles produced by soap-free emulsion polymerization or the like such as polymethyl methacrylate fine particles and polystyrene fine particles. For the polymer fine particle, it is preferable to use a polymer fine particle having a relatively narrow particle size distribution and a volume average particle diameter of 0.01 μm to 1 μm.

The use of the toner thus produced makes it possible to achieve stable developing and forming high-quality toner images. However, untransferred toner remaining on the surfaces of photoconductors and the surface of the intermediate transfer belt 61 is hardly removed by a cleaning device due to its fineness and excellent rolling ability and may sometimes pass through the cleaning device. To efficiently remove such untransferred toner from the photoconductors and the intermediate transfer belt 61, it is necessary that a toner removing member such as a cleaning blade be strongly pressed against the photoconductors and the like. A load applied for pressing the cleaning blade against the photoconductors not only shortens the operating lives of the photoconductors and cleaning device but also results in wasteful consumption of energy.

A reduction in the pressing force to the photoconductors and the like with the cleaning blade makes it possible to extend the operating lives of the photoconductors and the like, however, this may cause defective cleaning of photoconductor surfaces, resulting in damages on the photoconductor surfaces due to untransferred toner and carrier and a degradation in image formation performance of the printer section 1.

A copier according to the present invention is structured so as to prevent the photoconductor surface conditions from changing and to prevent the chargeability to photoconductors from changing on a high level and have high tolerable level with respect to low-resistance regions. In this configuration of the copier, the use of the toner as explained above makes it possible to stably obtain extremely high-quality images for a long period of time.

Note that for the toner, a definitely shaped toner produced by pulverization may be used. For materials of toner produced by pulverization, those used for electrophotographic toners can be used.

Examples of common binder resins used for toners produced by pulverization include styrenes and polymers of substitution products thereof such as polystyrene, poly-p-chlorostyrene, and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-methyl vinyl ketone copolymers, styrene-butadiene copolymers, styrene-isoprene copolymers, and styrene-maleic acid copolymers; acrylic ester-based monopolymers and copolymers thereof such as polymethyl acrylate, polybutyl acrylate, polymethyl methacrylate, and polybutyl methacrylate; polyvinyl derivatives such as polyvinyl chloride, and polyvinyl acetate; polyester polymers, polyurethane polymers, polyamide polymers, polyimide polymers, polyol polymers, epoxy polymers, terpene polymers, aliphatic or alicyclic hydrocarbon resins, and aromatic petroleum resins. These resins may be used alone or in combination. The binder resin used in the present invention is more preferably at least one selected from styrene-acrylate copolymer resins, polyester resins and polyol resins above mentioned, from the perspective of electric property and costs. Further, as binder resins exhibiting excellent fixing property, the use of a polyester resin and/or a polyol resin is further preferable.

As the same resin components contained in the coating layer of an electrostatic charge roller as the resin components constituting the binder resin in the toner, at least one selected from linear polyester resin compositions, linear polyol resin compositions, linear styrene acrylic resin compositions and crosslinked products thereof is preferably used. In production of a toner by pulverization, these resin components, the above-mentioned colorant components, wax components, charge controlling components and the like are pre-mixed in accordance with the necessity, the mixture is kneaded at a temperature equal to or lower than the melting point of the resin components, the kneaded product is cooled, followed by pulverization and classification process, thereby producing a toner. Further, external additives may be added and mixed in accordance with the necessity.

Hereinafter, features on the structure of the copier of the present invention will be described.

In FIG. 4, for the solid lubricant 21Y, a solid lubricant containing paraffin as a main component is used. The melting point of the paraffin primarily constituting the solid lubricant 21Y is preferably 70° C. to 130° C., and more preferably 75° C. to 125° C. When the melting point of the paraffin is lower than 70° C., the toner is likely to be deformed in storage at high-temperature. When the melting point is higher than 130° C., it is also unfavorable because the coating capability of the paraffin to the surface of the photoconductor 3Y is considerably degraded. The melting point of the paraffin can be measured by observing an endothermic peak associated with its dissolution while raising the temperature of the paraffin, for example, at a temperature increase rate of 10° C./min, by means of a differential scanning calorimeter (for example, DSC-60 manufactured by Shimadzu Corporation.

Examples of the paraffin primarily constituting the solid lubricant 21Y include normal paraffins and isoparaffins. A plural types of paraffins may be mixed. The proportion of the paraffin contained in the solid lubricant 21Y relative to the other components is preferably 20% by mass to 95% by mass, more preferably 40% by mass to 93% by mass, and still more preferably 50% by mass to 90% by mass. When the proportion of the paraffin is lower than 20% by mass, it is unfavorable because the effect of protecting the photoconductor 3Y from generated electrostatic discharge energy may be reduced, and the surface of the photoconductor 3Y is easily abraded away due to poor lubricity. When the proportion of the paraffin is higher than 95% by mass, it becomes difficult to equally cover the entire surface of the photoconductor 3Y with the lubricant powder. When the solid lubricant 21Y is made of only paraffin, it becomes difficult to form the lubricant power film thin on the surface of the photoconductor 3Y using only the coating brush roller 19Y and the leveling blade 23Y.

As materials to be mixed with the paraffin in the solid lubricant 21Y, hydrocarbons are exemplified, which are classified into amphipathic organic compounds, aliphatic unsaturated hydrocarbons, alicyclic saturated hydrocarbons, alicyclic unsaturated hydrocarbons and aromatic hydrocarbons. Besides the above-mentioned, fluorine resins and fluorine waxes such as polytetrafluoroethylene (PTFE), polyperfluoroalkylether (PFA), perfluoroethylene-perfluoropropylene copolymer (FEP), polyvinylidenefluoride (PVdF), and ethylene-tetrafluoroethylene copolymer (ETFE); silicone resins and silicone waxes such as polymethyl silicone, and polymethylphenyl silicone; and inorganic compounds having lubricity such as mica. These compounds may be used alone or in combination. Of these, amphipathic organic compounds, alicyclic saturated hydrocarbons are preferable because they can improve the coating property of the lubricant powder. Particularly, when an alicyclic saturated hydrocarbon such as cyclic polyolefin is used, the lubricant powder can be applied to the surface of the photoconductor 3Y in a film form.

For the alicyclic saturated hydrocarbon, cyclo-paraffins and cyclic polyolefins are exemplified. For the amphipathic organic compound, anionic surfactants, cationic surfactants, amphoteric surfactants, nonionic surfactants, and composite surfactants thereof are exemplified. Note that it is desirable to use a lubricant that does not adversely affect electric properties because the film composed of lubricant formed on the surface of the photoconductor 3Y also plays a roll of protecting the surface of the photoconductor 3Y from electrostatic discharge energy generated at the time of charging. From this viewpoint, the use of a nonionic surfactant as an amphipathic organic compound does not cause ionic dissociation of the surfactant itself, and thus even when the environment used is changed, in particular, the humidity is drastically changed, it is possible to prevent leakage of charge caused by electrostatic discharge in the air and to maintain image quality high.

As a nonionic surfactant to be used in the solid lubricant 21Y, it is preferable to use an ester compound obtained between an alkyl carboxylic acid and a polyhydric alcohol, which is represented by the following Chemical Formula 4.

$$C_nH_{2n+1}COOH \qquad \text{Chemical Formula 4}$$

(in Formula 4, "n" is an integer of 15 to 35.)

By using a straight-chain alkyl carboxylic acid as an alkyl carboxylic acid, hydrophobic parts of an amphipathic organic compound are easily arrayed on the surface of the photoconductor 3Y to which the amphipathic organic compound is adsorbed, and the adsorption density of the amphipathic organic compound to the photoconductor surface can be increased.

In an ester compound represented by Chemical Formula 4, alkyl carboxylic ester groups in one molecule exhibit hydrophobicity. With increased number of alkyl carboxylic ester groups per molecule, dissociated materials caused by electrostatic discharge in the air can be further prevented from adsorbing to the surface of the photoconductor 3Y and to reduce electric stress applied to the photoconductor surface corresponding to the charged area. However, the proportion of alkyl carboxylic ester occupied is excessively high, the sites of polyhydric alcohols exhibiting hydrophobicity are covered with the alkyl carboxylic ester, and sufficient adsorption capability cannot be exhibited depending on the surface state of the photoconductor 3Y. For this reason, the average number of ester bonds per molecule of the amphipathic organic compound is preferably 1 to 3. To satisfy the average number of ester bonds, one or more amphipathic organic compounds having different ester bonds can also be mixed and prepared.

For the amphipathic organic compounds, the above-mentioned anionic surfactants, cationic surfactants, amphoteric surfactants, and nonionic surfactants are exemplified.

Examples of the anionic surfactants include compounds in which anions at the terminals of their hydrophobic sites, such as alkylbenzenesulfonate, α-olefin sulfonate, alkane sulfonate, alkyl sulfate salt, alkyl sulfate polyoxyethylene salt, alkyl phosphate salt, long-chain fatty acid salt, α-sulfo fatty acid ester salt, or alkyl ether sulfate salt, are bonded to alkali metal ions such as sodium and potassium; alkali earth metal ions such as magnesium and calcium; metal ions such as aluminum and zinc; and/or ammonium ions.

Examples of the cationic ion surfactants include compounds in which cations at the terminals of their hydrophobic sites, such as alkyl trimethyl ammonium salt, dialkyl methyl ammonium salt, or alkyl dimethyl benzyl ammonium salt, are bonded to chlorine, fluorine, bromine, or phosphoric ions, nitrate ions, sulfate ions, thiosulfate ions, carbonate ions hydroxyl ions, and the like.

Examples of the amphoteric surfactants include dimethylalkylamine oxide, N-alkylbetaine, imidazoline derivatives, and alkylamino acids.

Examples of the nonionic surfactants include alcohol compounds, ether compounds and amide compounds such as long-chain alkyl alcohols, alkyl polyoxyethylene ether, polyoxyethylene alkyl phenyl ether, fatty acid dimethanol amide, alkylpolyglucoside, polyoxyethylene sorbitan alkyl ether. Besides the above-mentioned, ester compounds prepared between long-chain alkyl carboxylic acid such as lauric acid, palmitic acid, stearic acid, behenic acid, lignoceric acid, cerotic acid, montan acid, or melissic acid and polyhydric alcohol such as ethylene glycol, propylene glycol, glycerine, erythritol, and hexytol or partial anhydrides thereof.

Examples of the ester compounds include glyceryl alkylcarboxylates such as glyceryl monostearate, glyceryl distearate, glyceryl monopalmitate, glyceryl dilaurate, glyceryl trilaurate, glyceryl dipalmitate, glyceryl tripalmitate, glyceryl dimyristate, glyceryl trimyristate, glyceryl palmitate stearate, glyceryl monoarachidate, glyceryl diarachidate, glyceryl monobehenate, glyceryl stearate behenate, glyceryl cerotate stearate, glyceryl monomontanate, and glyceryl monomelissicate or substitution products thereof; and sorbitan alkylcarboxylates such as sorbitan monostearate, sorbitan tristearate, sorbitan monopalmitate, sorbitan dipalmitate, sorbitan tripalmitate, sorbitan dimiyristate, sorbitan trimyristate, sorbitan palmitate stearate, sorbitan monoarachidate, sorbitan diarachidate, sorbitan monobehanate, sorbitan stearate behenate, sorbitan cerotate stearate, sorbitan monomontanate, and sorbitan monomelissicate or substitution products thereof. The amphipathic organic compounds are not limited to the above-mentioned.

The above-mentioned amphipathic organic compounds may be used alone or in combination. Metal oxides, silicate compounds, mica or the like may be further added in accordance with the necessity.

The inventors of the present invention found in experiments that the use of the solid lubricant 21Y mentioned above makes it possible to maintain favorable lubrication property between the photoconductor 3Y and the cleaning blade 20Y and between the photoconductor 3Y and the leveling blade 23Y for a long period of time, thereby making it possible to efficiently prevent defective cleaning of untransferred toner for a long period of time. Further, the inventors also found that the use of the leveling blade 23Y makes it possible to excellently form a film of lubricant on the surface of the photoconductor 3Y for a long period of time, and the film of lubricant can efficiently prevent abrasion of the photoconductor 3Y for a long period of time. Furthermore, it was confirmed in the experiments that the surface of the photoconductor 3Y can be efficiently protected from the stress that could be caused by electrostatic discharge from the electrostatic charge roller 16Y.

As mentioned above, in the copier of the present invention, such an electrostatic charge roller type is employed as a charger for uniformly charge the surface of the photoconductor 3Y. Such roller type and brush type chargers can greatly reduce ozone generation as compared to corona discharge type chargers, however, disadvantageously, these types of chargers readily cause deterioration of the photoconductor 3Y due to electrostatic discharge energy. Even with the use of such an electrostatic charge roller type charger (or electrostatically charging brush type charger), it was possible to sufficiently protect the surface of the photoconductor 3Y from electrostatic discharge energy for a long period of time and sufficiently prevent deterioration of the photoconductor 3Y by covering the surface of the photoconductor 3Y with a lubricant powder containing paraffin as a main component.

Materials of the cleaning blade 20Y and the leveling blade 23Y are not particularly limited. Elastic materials such as urethane rubbers, hydrin rubbers, silicone rubbers and fluorine rubbers which are known as materials for cleaning blades may be used alone or in combination. The contact part of the cleaning blade 20Y with respect to the surface of the photoconductor 3Y may be coated or impregnated with a material having low-frictional coefficient. To adjust the hardness of the above-noted rubber materials, fillers typified by organic fillers and inorganic fillers may be dispersed in the rubber materials.

The cleaning blade 20Y and the leveling blade 23Y are respectively fixed to the blade holders 24Y and 26Y by bonding or fusing such that the edges of the cleaning blade 20Y and the leveling blade 23Y are strongly pressed against the photoconductor 3Y. For the thickness of the blade, the appropriate value varies in relation to the pressing force applied by springs, however, generally, the thickness is preferably 0.5 mm to 5 mm, and still more preferably 1 mm to 3 mm.

Further, for the amount of the blade protruded from the blade holder (free length), the appropriate value varies in relation to the pressing force by springs, however, generally, the free length is about 1 mm to 15 mm, and still more preferably about 2 mm to 10 mm.

As variant examples of the leveling blade 23Y, those prepared by forming a surface layer composed of a resin, rubber, or elastomer on a surface of an elastic metal blade such as blade by a coating or dipping method via a coupling agent or a primer component in accordance with the necessity are exemplified. Each of these leveling blades may be subjected to a heat curing treatment and further subjected to a surface polishing treatment, if necessary.

In the variant examples, the thickness of the elastic metal blade is about 0.05 mm to 3 mm, and still more preferably about 0.1 mm to 1 mm. For the purpose of preventing distortion of the elastic metal blade, after the elastic metal blade is mounted to a blade holder, and then the elastic metal blade may be bent in a direction substantially parallel with the spindle.

Examples of materials used for forming a surface layer of the blades in the variant examples include fluorine resins such as PFA, PTFE, FEP and PVdF; fluorine rubbers; and silicone elastomers such as methylphenyl silicone elastomers. Fillers may be mixed in these materials in accordance with the necessity.

The pressing force of the leveling blade 23Y with respect to the photoconductor 3Y is sufficient as long as the lubricant powder can be spread therewith. For example, it is, as expressed by linear pressure, within the range of 5 gf/cm to 80 gf/cm, and more preferably within the range of 10 gf/cm to 60 gf/cm.

The raised fiber filaments (fiber) used for brush roller section in the coating brush roller 19Y, it is preferable to use fiber that can exhibit appropriate pliability. For the pliable fiber, generally known materials may be used alone or in combination. Examples of the known materials include fibers composed of one or more selected from polyolefine resins (for example, polyethylene, and polypropylene); polyvinyl and polyvinylidene resins (for example, polystyrene, acrylic resin, polyacrylonitrile, polyvinyl acetate, polyvinyl alcohol, polyvinyl butyral, polyvinyl chloride, polyvinyl carbazole, polyvinyl ether, and polyvinylketones); vinyl chloride-vinyl acetate copolymers; styrene-acrylonitrile copolymers; styrene-butadiene resins; fluorine resins (for example, polytetrafluoroethylene, polyvinyl fluoride, polyvinylidene, and polychlortrifluoroethylene); polyesters; nylons; acrylates; rayon; polyurethanes; polycarbonates; phenol resins; and amino resins (for example, urea-formaldehyde resins, melamine resins, benzoguanamine resins, urea resins, and polyamide resins).

In order to control the flexure of the raised fiber filaments (fiber), diene rubber, styrene-butadiene rubber (SBR), ethylene propylene rubber, isoprene rubber, nitrile rubber, urethane rubber, silicone rubber, hydrin rubber, norbornene rubber or the like may be added to the above-mentioned resins.

As the coating brush roller 19Y, a brush roller prepared by wrapping a tape in which a pile fabric is brush-filled with a plurality of raised fiber filaments around a rotational shaft member made of metal in a spiral form, is exemplified. The raised fiber filaments (fiber) may be raised vertically on a rotational shaft member by electrostatic flocking. For the raised fiber filaments (fiber), it is preferable to use a fiber having a fiber diameter of 10 μm to 500 μm and a fiber length of 1 mm to 15 mm. The flocking density of the raised fiber filaments (fiber) is preferably controlled within the range of 10,000 per square inch to 300,000 per square inch ($1.5\times10^7$ to $4.5\times10^8$ per square inch).

For the raised fiber filaments (fiber), one fiber prepared by bundling several fine fiber filaments to several hundreds of fine filaments may be employed. For example, those prepared by bundling 50 fine fiber filaments of 6.7 decitex (6 denier) into one fiber, like 333 decitex=6.7 decitex×50 filaments (300 denier=6 denier×50 filaments) are exemplified. However, in this configuration, when the tip of the fiber filaments delicately fluffs, the effect of scraping out the lubricant from a portion relatively thick in a lubricant film formed on the photoconductor is reduced, and thus there may be difficulty in evenly leveling out the thickness of the lubricant film. For this reason, it is desired to use a fiber composed of one fiber filament which is relatively thick, from the viewpoint of evenly leveling out the thickness of the lubricant film. The configuration makes it possible to excellently scrape out the lubricant from a portion relatively thick in the lubricant film formed on the photoconductor.

Further, a coating layer may be formed on the circumferential face of the brush roller section in the coating brush roller 19Y for the purpose of stabilizing the configuration of the brush circumferential face. The material constituting the coating layer is not particularly limited as long as it is deformable in accordance with the flexure of raised fiber filaments (fiber) used. Examples of the materials include polyolefine resins such as polyethylene, polypropylene, polyethylene chloride, and chlorosulfonated polyethylene; polyvinyl and polyvinylidene resins such as polystyrene, acrylates (polymethyl methacrylate, etc.), polyacrylonitrile, polyvinyl acetate, polyvinyl alcohol, polyvinyl butyral, polyvinyl chloride, polyvinyl carbazole, polyvinyl ether, and polyvinylketone; vinyl chloride-vinyl acetate copolymers; silicone resins composed of organosiloxane bonds or modified products thereof (such as modified products of alkyl resin, polyester resin, epoxy resin, polyurethane, or the like); fluorine resins such as perfluoroalkylether, polyfluorovinyl, polyfluorovinylidene, and polychlortrifluoroethylene; polyamides; polyesters; polyurethanes; polycarbonates; amine resins such as urea-formaldehyde resins; epoxy resins or composite resins thereof.

Configuration of the process unit 2Y for Y toner has been explained above, and the process units 2M, 2C and 2K for M, C and K toners respectively have the same configuration as that of the process unit 2Y for Y toner. Thus, descriptions thereof are omitted.

EXAMPLES

Hereafter, the present invention will be further described in detail referring to specific Examples, however, the present invention is not limited to the disclosed Examples. On the contrary, the present invention is intended to cover various modifications and equivalent arrangements included within the spirit and scope of the appended claims.

Experiment 1

The inventors produced 21 samples of solid lubricants of Sample Nos. (1) to (21) as follows. Firstly, the components shown in Table 1 were put in a glass vessel with a lid. The components were agitated and melted with a hot stirrer under a predetermined temperature condition (the melting point shown in Table 2) to obtain a melt. Next, an aluminum die with an inside size of 12 mm×8 mm×350 mm was heated to the pre-heating temperature shown in Table 2. The melt was poured into the heated die and then naturally cooled down to a first cooling temperature (shown in Table 2). Next, the die was placed in a thermostatic bath, heated again to a reheating temperature (shown in Table 2), left intact under the temperature for a predetermined time (re-heating time shown in Table 2) and then naturally cooled down to the final cooling temperature shown in Table 2. A solid matter of lubricant obtained by the standing to cool was taken out from the die, and cut-formed in 7 mm×8 mm×310 mm, thereby obtaining solid lubricant samples (1) to (21) in Table 1.

TABLE 1

| | Hydrophobic organic compound | | | Amphipathic organic compound | | | Other compound | |
|---|---|---|---|---|---|---|---|---|
| Sample No. | Component | Mw | Use amount [% by mass] | Component | HLB | Use amount [% by mass] | Component | Use amount [% by mass] |
| (1) | NP | 640 | 60 | ST | 1.5 | 40 | — | — |
| (2) | NP | 640 | 75 | SS | 5.9 | 25 | — | — |
| (3) | NP | 640 | 75 | ST | 3.5 | 25 | — | — |
| (4) | MCW | 700 | 60 | ST | 1.5 | 40 | — | — |
| (5) | NP | 640 | 97 | ST | 1.5 | 3 | — | — |
| (6) | NP | 640 | 10 | ST | 1.5 | 90 | — | — |
| (7) | NP | 640 | 99 | ST | 1.5 | 1 | — | — |
| (8) | NP | 640 | 5 | ST | 1.5 | 95 | — | — |
| (9) | NP | 930 | 75 | SP | 6.5 | 25 | — | — |
| (10) | NP | 350 | 75 | SS | 5.9 | 25 | — | — |
| (11) | NP | 480 | 60 | ST | 1.5 | 40 | — | — |
| (12) | NP | 480 | 75 | SS | 5.9 | 25 | — | — |
| (13) | NP | 640 | 45 | ST | 1.5 | 30 | corn starch | 25 |
| (15) | NP | 640 | 36 | ST | 1.5 | 24 | corn starch | 40 |
| (15) | NP | 300 | 75 | SS | 5.9 | 25 | — | — |
| (16) | IPW | 700 | 60 | ST | 1.5 | 40 | — | — |
| (17) | — | — | — | ST | 1.5 | 100 | — | — |
| (18) | — | — | — | SS | 5.9 | 100 | — | — |
| (19) | — | — | — | SE | 3.5 | 100 | — | — |
| (20) | — | — | — | zinc stearate | 1.2 | 100 | — | — |
| (21) | — | — | — | higher alcohol | <0.1 | 100 | — | — |

NP: normal paraffin
IPW: isoparaffins wax
SS: sorbitan monostearate
MCW: microcrystalline wax
ST: sorbitan tristearate
SE: glycerin monostearate

TABLE 2

| Sample No. | Fusion temperature [° C.] | Pre-heating temperature of die [° C.] | First cooling temperature [° C.] | Reheating temperature [° C.] | Reheating time [min] | Final cooling temperature [° C.] |
|---|---|---|---|---|---|---|
| (1) | 120 | 85 | 50 | 60 | 20 | 25 |
| (2) | 120 | 85 | 50 | 60 | 20 | 25 |
| (3) | 120 | 85 | 50 | 60 | 20 | 25 |
| (4) | 120 | 85 | 50 | 60 | 20 | 25 |
| (5) | 120 | 85 | 50 | 60 | 20 | 25 |
| (6) | 120 | 85 | 50 | 60 | 20 | 25 |

TABLE 2-continued

| Sample No. | Fusion temperature [° C.] | Pre-heating temperature of die [° C.] | First cooling temperature [° C.] | Reheating temperature [° C.] | Reheating time [min] | Final cooling temperature [° C.] |
|---|---|---|---|---|---|---|
| (7) | 120 | 85 | 50 | 60 | 20 | 25 |
| (8) | 120 | 85 | 50 | 60 | 20 | 25 |
| (9) | 160 | 120 | 40 | 55 | 20 | 27 |
| (10) | 80 | 45 | — | — | — | 28 |
| (11) | 100 | 65 | 45 | 60 | 20 | 29 |
| (12) | 100 | 65 | 45 | 60 | 20 | 30 |
| (13) | 120 | 85 | 50 | 60 | 20 | 31 |
| (14) | 120 | 85 | 50 | 60 | 20 | 32 |
| (15) | 100 | 50 | 35 | 45 | 20 | 33 |
| (16) | 110 | 70 | 50 | 60 | 20 | 25 |
| (17) | 90 | 50 | — | — | — | 26 |
| (18) | 90 | 50 | — | — | — | 27 |
| (19) | 90 | 50 | — | — | — | 28 |
| (20) | 180 | 130 | — | — | — | 29 |
| (21) | 120 | 75 | — | — | — | 30 |

As a test machine having a similar configuration to that of a copier according to the embodiment as illustrated in FIG. 1, Color MFP IMAGIO NEO C600 (manufactured by Ricoh Company Ltd.) was prepared. As photoconductors for Y, M, C, K toners to be mounted to the test machine, photoconductors each having a surface layer of 5 μm in thickness containing a thermosetting resin (polyfunctional acrylate resin of thermal radical reaction type in its surface were produced, and were mounted as photoconductors for Y, M, C, and K toners to the test machine.

While sequentially replacing solid lubricants mounted to the respective process units in the test machine with some of the above-mentioned 21 samples of (1) to (21), 10,000 sheets of a color-test image were continuously output for each of the solid lubricants. The color test image was formed on paper in A4 size with an image area ratio of 6%.

An image state at the initial stage of the continuous output and an image state of the $100{,}000^{th}$ sheet printed were observed, and image qualities thereof were evaluated. With respect to the image quality, the following three items were evaluated: fine streaks attributable to defective cleaning of photoconductors; background smear attributable to defective cleaning (adhesion of toner to a non-image portion); and image blur attributable to deterioration of photoconductors caused by discharge energy at the time of electrostatic discharge. These evaluation items were ranked into four grades. A: extremely superior, B: there is no problem in practical use, C: it is within allowable limits in practical use, and D: not usable.

After outputting 100,000 sheets, the photoconductors, cleaning blades and electrostatic charge rollers were taken out from the individual process units in the test machine. The deterioration degree of the respective photoconductors, cleaning blades and electrostatic charge rollers was evaluated and ranked into the following three grades. A: on the same level as in the initial stage, B: slightly deteriorated (there is no problem in practical use), and C: conspicuously deteriorated.

Tables 3 to 5 show the results of the experiments described above.

TABLE 3

| Sample No. | Fine streaks in the initial stage of printing | Background smear in the initial stage of printing | Image blur in the initial stage of printing |
|---|---|---|---|
| (1) | A | A | A |
| (2) | A | A | A |
| (3) | A | A | A |

TABLE 3-continued

| Sample No. | Fine streaks in the initial stage of printing | Background smear in the initial stage of printing | Image blur in the initial stage of printing |
|---|---|---|---|
| (4) | A | A | A |
| (5) | A | A | A |
| (6) | A | A | A |
| (7) | A | A | A |
| (8) | A | A | A |
| (9) | A | A | A |
| (10) | A | A | A |
| (11) | A | A | A |
| (12) | A | A | A |
| (13) | B | A | A |
| (14) | B | B | A |
| (15) | A | A | A |
| (16) | A | A | A |
| (17) | A | A | A |
| (18) | A | A | A |
| (19) | A | A | A |
| (20) | A | A | A |
| (21) | B | A | A |

TABLE 4

| Sample No. | Fine streaks after printing 100,000 sheets | Background smear after printing 100,000 sheets | Image blur after printing 100,000 sheets |
|---|---|---|---|
| (1) | A | A | A |
| (2) | A | A | A |
| (3) | A | A | A |
| (4) | A | A | A |
| (5) | A | A | A |
| (6) | A | A | A |
| (7) | A | A | A |
| (8) | B | A | A |
| (9) | A | A | A |
| (10) | A | A | A |
| (11) | A | B | A |
| (12) | A | A | A |
| (13) | B | A | B |
| (14) | C | B | B |
| (15) | A | C | A |
| (16) | A | C | A |
| (17) | D | A | A |

TABLE 4-continued

| Sample No. | Fine streaks after printing 100,000 sheets | Background smear after printing 100,000 sheets | Image blur after printing 100,000 sheets |
|---|---|---|---|
| (18) | C | A | A |
| (19) | D | C | C |
| (20) | D | A | A |
| (21) | D | A | A |

TABLE 5

| Sample No. | Deterioration of photoconductor after printing 100,000 sheets | Deterioration of cleaning blade after printing 100,000 sheets | Deterioration of electrostatic charge roller after printing 100,000 sheets |
|---|---|---|---|
| (1) | A | A | A |
| (2) | A | A | A |
| (3) | A | A | A |
| (4) | A | A | A |
| (5) | A | A | A |
| (6) | A | A | A |
| (7) | A | B | A |
| (8) | B | A | A |
| (9) | B | B | A |
| (10) | B | A | A |
| (11) | A | A | A |
| (12) | B | A | A |
| (13) | B | A | A |
| (14) | B | B | B |
| (15) | B | B | A |
| (16) | B | A | A |
| (17) | C | B | A |
| (18) | C | B | B |
| (19) | C | A | C |
| (20) | C | C | C |
| (21) | C | C | C |

The results shown in these Tables demonstrate that the solid lubricant samples (1) to (16) containing paraffin as a main component made it possible to efficiently protect the surface of a photoconductor 3Y from stress caused by electrostatic discharge from an electrostatic charge roller 16Y while excellently preventing defective cleaning attributable to untransferred toner as well as abrasion of the photoconductor 3Y for a long period of time, even after continuously outputting 100,000 sheets; whereas, in the solid lubricant samples (17) to (21) containing no paraffin, abnormal images attributable to defective cleaning caused by untransferred toner and to deterioration of a photoconductor 3Y were observed conspicuously, and the deterioration of each of the members was conspicuous.

As demonstrated above, a lubricant containing paraffin as a main component is extremely superior in overall performance. However, the inventors further conducted an experiment, and it was found that there were fine streaks observed in printed images depending on the circumstances. The fine streaks were formed larger than the above-mentioned fine streaks.

The inventors examined a cause which generates the fine streaks. The examination showed that on the surface of the photoconductor 3Y, the potential of the exposed portion in the latent electrostatic image corresponding to the fine streaks was not sufficiently attenuated. It seemed that this phenomenon was caused by defective exposure occurred at that portion attributable to an excessive thickness of the lubricant film corresponding to that portion.

Then, the inventors further conducted the following experimental test to examine a relation between the thickness of a lubricant film formed on the surface of a photoconductor and defective exposure.

Experiment 2

Firstly, a solid lubricant was produced as follows. A normal paraffin having a melting point of 104° C. (79 parts by mass), a normal paraffin having a melting point of 112° C. (10 parts by mass) and 11 parts by mass of a cyclic polyolefin having a melting point of 60° C. (TOPAS™ available from Ticona Co.) were put in a glass vessel with a lid. The components were agitated and melted with a hot stirrer at a temperature of 125° C. to obtain a melt. Next, an aluminum die with an inside size of 12 mm×8 mm×350 mm was heated to 88° C. The melt was poured into the heated die and then naturally cooled down to 50° C. Next, the die was placed in a thermostatic bath, heated again to 60° C., left intact under the temperature for 20 minutes and then naturally cooled down to the room temperature. A solid matter of lubricant obtained by the standing to cool was taken out from the die, and cut-formed in 7 mm×8 mm×310 mm, thereby obtaining a solid lubricant sample.

As a test machine having a similar configuration to that of a copier according to the embodiment as illustrated in FIG. 1, a copier was prepared in which an intermediate transfer belt and developing devices for each color were taken out from Color MFP IMAGIO NEO C600 (manufactured by Ricoh Company Ltd.). Photoconductors for Y, M, C, K toners to be mounted to the test machine were manufactured as follows. Over a surface of an aluminum drum (conductive substrate) having a diameter of 40 mm, an undercoat layer having a thickness of 3.6 μm, a charge generating layer having a thickness of 0.15 μm, a charge transporting layer having a thickness of 25 μm, and a surface protective layer having a thickness of about 3.7 μm were formed in this order. The surface protective layer was formed by spray coating the surface of the charge transporting layer with a material and drying the applied material. The layers other than the surface protective layer were respectively formed by dip coating using a material and drying the applied material. As the material of the surface protective layer, 10 parts by mass of Z-type polycarbonate, 7 parts by mass of triphenyl amine compound (see the following Chemical Formula 5), 5.5 parts by mass of aluminum oxide fine particles (particle diameter: 0.16 μm), 400 parts by mass of tetrahydrofuran and 150 parts by mass of cyclohexanone were mixed, and the mixture was used.

Chemical Formula 5

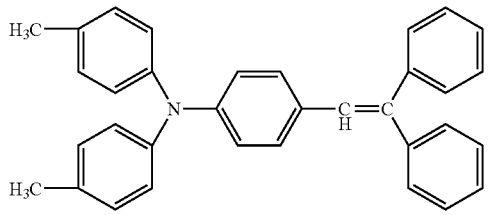

Four of the thus manufactured photoconductors were prepared and mounted as photoconductors for Y, M, C, and K toners in the test machine. The prepared solid lubricant samples were respectively set in process units for Y, M, C, and K toners.

While driving the photoconductors for each color at a linear velocity of 282 mm/sec, and rotationally driving coating brush rollers in each of the process units, the driving was stopped once every 10 minutes, and an image of the state of formation of a lubricant film formed on each surface of the photoconductors was taken using a highly sensitive camera. At that time, each of the photoconductors was not subjected to electrostatic charging and optical scanning processes and was put in an idling state. A cleaning blade and a leveling blade in each of the process units were made contact with the corresponding photoconductor as per usual process. For the coating brush rollers for each color, those having a diameter of 8 mm and an average fiber length of 4.0 mm were used. Each of the coating brush rollers was made contact with the corresponding photoconductor so that the tip of the brush bit into the surface of the corresponding photoconductor by a bite amount of 1 mm. Under the above-noted conditions, the state of formation of a lubricant film formed on each of the photoconductors was observed for 160 minutes from the start of the experimental test.

As a result, it was found that the thickness of a lubricant film formed on each of the photoconductor surface is gradually increased until 90 minutes after the start of the experimental test, as time goes by, but after a lapse of 100 minutes, the thickness of the lubricant film is not grown and the increase in thickness is saturated.

Subsequently, for the purpose of changing the coatability of the lubricant powder by the coating brush rollers in each of the process units, a similar experimental test to the above mentioned test was conducted except that springs for biasing the solid lubricant sample applied to each of the brush rollers were changed to springs having a spring constant different form that of the previously set springs. This experimental test was repeatedly conducted with varying springs having various spring constants. As a result, it was found that when using any of the springs employed, the increase in thickness of a lubricant film reached a saturation level by the time 120 minutes had elapsed. However, the saturated thicknesses of lubricant film at the time of using each of the springs employed were different from each other. This means that the saturated thickness varies depending on the difference in coating amount of a lubricant powder per unit time, i.e., the coated amount varies depending on the difference in spring-biased force, however, the thickness of lubricant film reached a saturated level, in any one of coating amount, by the time 120 minutes had elapsed from the start of coating.

The reason why the thickness of a lubricant film reaches a saturation level by the time 120 minutes has elapsed from the start of coating irrespective of the coating amount can be considered as follows. A lubricant powder applied over the surface of a photoconductor is further covered with the lubricant powder on its surface to gradually grow to a specific film thickness. In the meanwhile, part of the lubricant powder is scraped out with a cleaning blade and a coating brush roller. The amount of the solid lubricant scraped out is increased, as the thickness of the lubricant film is increased. Therefore, it can be considered that the growth amount of the lubricant film associated with the coating of the lubricant powder and the amount of scraped out of the solid lubricant by means of a blade and a brush are balanced by the time 120 minutes has elapsed from the start of coating, thereby the increase in film thickness reaches its saturation level.

Examples 1 to 5 and Comparative Example 1

Experiment 3

As photoconductors for Y, M, C and K toners, six new photoconductors were prepared for each color toner, i.e., 24 photoconductors were prepared in total so that an experiment could be repeated six times (Experiments A to F) while replacing each color photoconductor with a new one in appropriate time. Further, as coating brush rollers for Y, M, C and K toners, six coating brush rollers for each color, i.e., 24 coating brush rollers were prepared in total for repeating the experiment 6 times. Configurations of the electrostatic charge brush rollers are as follows.

(1) Electrostatic Charge Roller for Experiments A, B and C (Examples 1 to 3 diameter of brush roller section: 8 mm
bite amount of the brush tip into photoconductor: 1 mm
average diameter of raised fiber filaments (fiber): 31 μm
average length of fiber filaments: 4.0 mm
material of fiber: conductive polyester
flocking density of fiber filaments: 3,500/inch$^2$
method of fiber flocking: electrostatic flocking
pressing force of solid lubricant sample applied to brush
Experiment A (Example 1): 3.6 N
Experiment B (Example 2): 4.4 N
Experiment C (Example 3): 5.0 N (2) Electrostatic Charge Roller for Experiment D (Example 4)

diameter of brush roller section: 8 mm
bite amount of the brush tip into photoconductor: 1 mm
structure of fiber: 850 fiber filaments each having approximately 2 μm diameter are bundled and twisted
average diameter of raised fiber filaments (fiber): about 60 μm
average length of fiber filaments: 4.0 mm
material of fiber: polyester
flocking density of fiber filaments: 3,000/inch$^2$
method of fiber flocking: U weave (leiotrichous brush)
pressing force of solid lubricant sample applied to brush 4.6 N (3) Electrostatic Charge Roller for Experiment E (Example 5)

diameter of brush roller section: 8 mm
bite amount of the brush tip into photoconductor: 1 mm
structure of fiber: 1,000 filaments each having approximately 1.8 μm diameter are bundled and twisted
average diameter of raised fiber filaments (fiber): about 61 μm
average length of fiber filaments: 4.0 mm
material of fiber: polyester
flocking density of fiber filaments: 2,900/inch$^2$
method of fiber flocking: U weave (leiotrichous brush)
pressing force of solid lubricant sample applied to brush 4.8 N (4) Electrostatic Charge Roller for Experiment F (Comparative Example 1)

diameter of brush roller section: 8 mm
bite amount of the brush tip into photoconductor: 1 mm
structure of fiber: 1,000 filaments each having approximately 1.8 μm diameter are bundled and twisted
average diameter of raised fiber filaments (fiber): about 61 μm
average length of fiber filaments: 4.0 mm
material of fiber: polyester
flocking density of fiber filaments: 2,900/inch$^2$
method of fiber flocking: U weave (leiotrichous brush)
pressing force of solid lubricant sample applied to brush 5.2 N A new photoconductor, a new coating brush roller for Experiment A, and a new solid lubricant sample (same as used in Experiment 2) were set in each of process units for Y, M, C and K, and the lubricant was continuously applied onto each of the photoconductors for 120 minutes in the same manner as in Experiment 2 at a temperature of 23° C. and a relative humidity of 55%. Thereafter, the photoconductors were taken out from each of the process units, and surface samples were cut out from each of the lubricant films on the photoconductors to measure the thickness of the lubricant thickness.

Cutting of the surface samples was conducted as follows. Specifically, surface sample were cut out at a center portion in an axis line direction of each of the photoconductors and both edge portions thereof (portions situated somewhat nearer the center by 50 mm in relation to the edges of each of the photoconductors), i.e, from three portions in total. Each of the surface protective layers was sliced to a thickness of approximately 80 nm by means of an ultra microtome (ULTRACUT J, manufactured by REICHERT-JUNG Co.) to prepare sample sections. The sample sections thus obtained from the center portion and both edge portions were set in a transmission electron microscope (JEM-2010, manufactured by JEOL Ltd.) to measure a maximum thickness of each of lubricant films formed on each of the samples.

The lubricant film formed on the surface of one photoconductor microscopically varied in thickness. Then, the film thickness of each of the sample sections was measured within the range of 5 μm in an axis line of the photoconductor to examine a maximum film thickness. The highest value in the maximum film thicknesses of the three sample sections was determined as the maximum film thickness. The measurement of film thickness was carried out with respect to the photoconductors for Y, M, C, and K toners. As a result, it was found that the maximum film thicknesses of lubricant films on the photoconductors for Y, M, C and K were substantially same.

In order to examine whether or not a lubricant film was evenly formed, ellipsoidal regions each 700 μm in major axis diameter and 300 μm in minor axis diameter were cut out at a center portion and both edge portions thereof (portions situated somewhat nearer the center by 50 mm in relation to the edges of each of the photoconductors) in each of the photoconductors as test samples. The test samples were respectively subjected to C1s spectrum analysis of XPS (X-ray photoemission spectroscopy) (AXIS/ULTRA, Shimazu/KRATOS, X-ray source: Mono Al, analysis region: 700 μm×300 μm). Specifically, ellipsoidal regions of same size were cut out from a surface of a photoconductor that had not yet been coated with a lubricant, i.e., from the solid surface of the photoconductor, and used as test targets. The test targets were subjected to C1s spectrum analysis of XPS. Among a plurality of waveforms generated by a plurality of carbon bond structures which are different from each other in a C1s spectrum, the dimensional ratio of a composite waveform composed of a plurality of waveforms having peaks of intensity (peaks obtained by separating waveforms generated depending on bonding states of different carbons based on the bond energies) within the range of bond energy values of 290.3 eV to 294 eV relative to the entire dimension of the plurality of waveforms under the C1s spectrum was determined as A0[%]. Note that in the photoconductors used in the Experiment, polycarbonate was contained. The waveforms having peaks of intensity within the range of bond energy values of 290.3 eV to 294 eV in the C1s spectrum obtained by XPS analysis appears attributable to carbonate bonds in the polycarbonate resin, CTM (charge transporting materials) in each of the photoconductors, or π-π* transition of benzene rings in the polycarbonate resin.

Subsequent to the C1s spectrum analysis on the solid surface of the photoconductors, the lubricant was continuously applied on the surface of a photoconductor for 120 minutes to form a lubricant film with a saturated film thickness, and then the photoconductor was subjected to C1s spectrum analysis similarly to the above, the dimensional ratio of a composite waveform composed of a plurality of waveforms having peaks of intensity within the range of bond energy values of 290.3 eV to 294 eV relative to the entire dimension of the plurality of waveforms under the C1s spectrum was determined as At [%].

Figure 5:
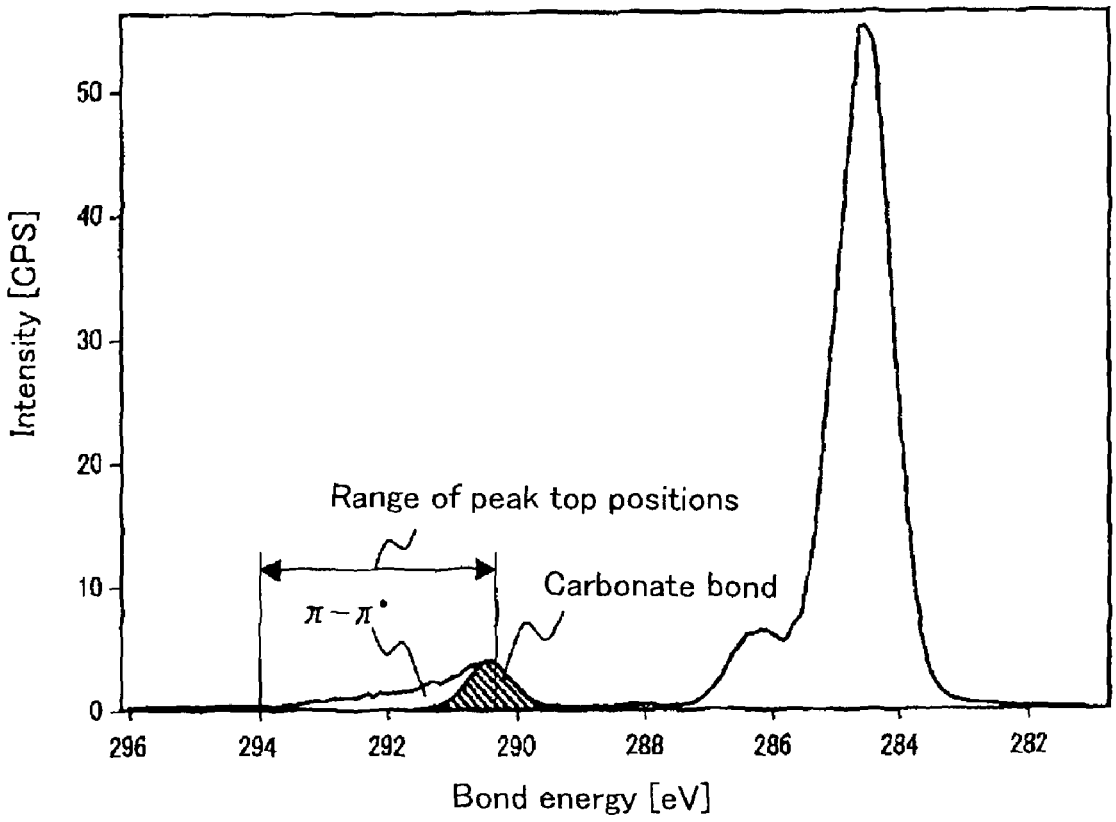
FIG. 5 is a graph exemplarily showing a waveform of C1s spectrum on a photoconductor surface to which a lubricant has not yet been applied.

FIG. 5 is a graph showing one example of a waveform of C1s spectrum of a photoconductor surface to which a lubricant has not yet been applied. In the graph shown in FIG. 5, a waveform having peaks of intensity within bond energy values of 290.3 eV to 294 eV is separated into two waveforms, i.e., a waveform derived from carbonate bonds (shaded portion in the figure) and a waveform attributable to π-π* transition (left side portion adjacent to the shaded portion in the figure). The waveform attributable to π-π* transition is a composite waveform in which a plurality of waveforms generated by a plurality of carbon bond structures different from each other are overlaid, and under ordinary circumstances, it is necessary to separate the waveform into waveforms for every carbon bond structure and to determine the dimension for each waveform. However, when all peaks of intensity attributable to π-π* transition in individual waveforms are within the range of 290.3 eV to 294 eV, the entire dimension of the individual waveforms obtained in the C1s spectrum becomes the same as the dimension of the composite waveform. Therefore, there is no need to separate the waveform attributable to π-π* transition. When among the individual waveforms attributable to π-π* transition, there is/are a waveform or waveforms having peaks of intensity which are out of the range of 290.3 eV to 294 eV, it is necessary to subtract the dimension of the waveform(s) from the dimension of the composite waveform. Note that when intensities at the foot of the waveform are not within the range of 290.3 eV to 294 eV but peaks of intensity of the waveform are within the range of 290.3 eV to 294 eV, it is necessary to determine the dimension including the foot region of the waveform, in which intensities are out of the range of 290.3 eV to 294 eV.

FIG. 5 shows the results of a photoconductor surface to which a lubricant has not yet been applied, as a specimen, however, in the case of a photoconductor surface after being covered with the lubricant, the dimension of a waveform having peaks of intensity within bond energy values of 290.3 eV to 294 eV is smaller than the dimension of the waveform shown in FIG. 5. This is because the XPS is a method for analyzing the state of chemical bond of the atoms present close to the surface of a specimen only in depth of 5 nm to 8 nm from the surface, and thus when a lubricant film thicker than the depth range is present, it becomes difficult to detect waveforms derived from carbonate bonds and waveforms attributable to π-π* transition. Thus, with increased coverage of the lubricant film, the value obtained by subtracting the At [%] from the A0[%] is increased. Accordingly, when the value calculated by the expression or condition [(A0−At)/A0×100 [%]] indicates a certain value or a value higher than the certain value, this means that the lubricant film is evenly formed on the photoconductor surface. The values obtained from the expression, [(A0−At)/A0×100 [%]] on each of the photoconductors for Y, M, C and K toners were determined. As a result, these values were substantially same.

The measurement of a maximum thickness of lubricant film and the measurement of [(A0−At)/A0×100 [%]] were carried out on the brush rollers of Experiment B, C, D, E and F (Examples 2 to 5 and Comparative Example 1) as well. Table 6 shows the measurement results.

TABLE 6

| Experiment | Maximum thickness of lubricant film [μm] | (A0 − At)/(A0 × 100) [%] |
|---|---|---|
| A (Example 1) | 0.059 | 91 |
| B (Example 2) | 0.065 | 98 |
| C (Example 3) | 0.060 | 100 |
| D (Example 4) | 0.15 | 75 |
| E (Example 5) | 0.23 | 70 |
| F (Compara. Ex. 1) | 0.26 | 68 |

Experiment 4

Next, the inventors prepared 24 new photoconductors were prepared, which were constructed similarly to those used in Experiment 3 were prepared. Further, 24 coating brush rollers were prepared, which were constructed similarly to the brush rollers for Experiments A, B, C, D, E and F. Then, a lubricant film was formed on the photoconductor surfaces in the same conditions as in Experiments A, B, C, D, E, and F (Examples 1 to 5 and Comparative Example 1) in [Experiment 3], and a color test image having an image area ratio of 4.5% was output on paper in A4 size (in lateral conveyance direction) under the conditions of use each of the lubricant films formed.

As to Y, M, C, K toners, toners produced by polymerization and having a weight average particle diameter (D4) of 5.1 μm, a number average particle diameter (D1) of 4.4 μm, and an average circularity of 0.98 were used. As to test prints, the color test image was printed at a temperature of 23° C. and a relative humidity of 55%. A continuous output of 5 print sheets was regarded as 1 unit, and 200 units were printed (1,000 sheets in total). On the 1,000$^{th}$ sheet of the color test image, presence or absence of fine streaks caused by defective exposure of the photoconductors was checked. Subsequently, after 5,000 sheets of the color test image were further output, on the 5,000$^{th}$ sheet (6,000$^{th}$ sheet cumulatively) of the color test image, presence or absence of fine streaks caused by defective exposure of the photoconductors was checked. Thereafter, the test environment was changed to a temperature of 27° C. and a relative humidity of 75%, 1,000 sheets of the color test image were further output. Then, on the 1,000$^{th}$ sheet (7,000$^{th}$ sheet cumulatively) of the color test image, presence or absence of fine streaks was checked. These print sheets were evaluated as to presence or absence of fine streaks and ranked into the following four grades.

A: no fine streak was observed even through use of a magnifier.

B: a slight amount of fine streaks was observed with use of a magnifier.

C: a slight amount of fine streaks was observed when stared at.

D: fine streaks were observed even when not stared at.

The allowable levels on fine streaks are grade C or above, i.e., grades A, B and C. Table 7 shows the evaluation results.

TABLE 7

| Experiment | Maximum thickness of lubricant film [μm] | Presence or absence of fine streaks in print images after outputting standard image | | |
|---|---|---|---|---|
| | | After outputting 1,000 sheets | After outputting 6,000 sheets | After outputting 7,000 sheets |
| A (Example 1) | 0.059 | A | A | Not tested |
| B (Example 2) | 0.065 | A | A | A |
| C (Example 3) | 0.060 | A | A | A |
| D (Example 4) | 0.15 | A | A | A *1 |
| E (Example 5) | 0.23 | A | A *2 | Not tested |
| F (Compara. Ex. 1) | 0.26 | D | Not tested | Not tested |

*1: Fine streaks were not observed, but the print sheet was slightly inferior in image sharpness.
*2: Fine streaks were not observed, but relatively large streaky image density differences attributable to toner adhesion appeared from about the 2,250$^{th}$ print sheet.

As shown in Table 7, with the use of any of the brush rollers of Experiments A, B, C, D and E (Examples A, B, C, D and E), no fine streak did not occur in the output of 5,000 sheets. Whereas, the brush roller of Experiment F (Comparative Example F) caused fine streaks which were well below the allowable levels. When the results of the degree of occurrence of fine streaks and the maximum thickness (0.23 μm) of lubricant film in Experiment E (Example 5) are compared with the results of the degree of occurrence of fine streaks and the maximum thickness (0.26 μm) of lubricant film in Experiment F (Comparative Example 1), it can be considered that the occurrence of fine streaks can be prevented by controlling the maximum thickness of the lubricant film to 0.25 μm or less.

The reason why streaky image density differences started to appear from about the output of the 2,250$^{th}$ sheet is as follows. At portions in a photoconductor surface, on which a lubricant film is not formed, with increased number of output sheets, the amount of toner adhered on the surface of the photoconductor is increased, and the potential of the latent electrostatic image is reduced. For this reason, streaky image density differences occur, which are caused by partly low image density of the latent electrostatic image. When the difference in thickness between a portion of a lubricant film having the maximum thickness and a portion of the lubricant film having the minimum thickness (or a portion to which the lubricant is not applied) is relatively small, it is difficult to visually check the image density difference, however, when the difference in thickness is relatively large, the image density difference are conspicuously observed. In Experiment E (Example 5), because the difference in thickness therebetween was relatively large, a reduction in potential of the latent electrostatic image started to appear due to adhesion of toner components to a portion or portions where the lubricant film was thin (or a portion or portions on which a lubricant film was not formed) from approximately the 2,250$^{th}$ output sheet, and the adhesion of toner components caused the streaky image density differences. Adhesion of toner components is likely to occur as the temperature and humidity becomes higher. This is why the image sharpness began to degrade during the output of the 6,000$^{th}$ sheet to 7,000$^{th}$ sheet in Experiment D (Example 4) where the environmental conditions were changed to be higher temperature and humidity.

Image forming apparatuses in recent years generally have a plurality of image forming modes such as modes giving preference to processing speeds, standard modes, and modes giving preference to image qualities over processing speeds. In such configurations of image forming apparatuses, there is a need to set the conditions of coating a photoconductor surface with a lubricant by means of a coating brush roller so that the maximum thickness of a lubricant film is 0.25 μm or less.

As described above, the occurrence of fine streaks is attributable to an insufficient amount of exposure from an optical writing unit in local positions on a photoconductor surface where thickness of a lubricant film is excessively increased. In contrast to the above case, in local positions on a photoconductor surface where the thickness of a lubricant film is excessively thin, toner adhesion or toner filming occurs, and degradation of a photosensitive layer is caused due to electrostatic charge energy at the time of uniformly electrostatically charging the photoconductor surface. Then, in Experiments A, B, C, D and E (Examples 1 to 5), the 2,250$^{th}$ color test image was checked, but abnormal images due to toner adhesion and degradation of each of the photosensitive layers were not observed. Further, after outputting the 2,250$^{th}$ sheet, the photoconductors for each color were observed, but toner adhesion and defective cleaning were not observed. As can be seen in Table 6, with increased value of [(A0−At)/A0×100 [%]], the coverage of the lubricant film with respect to the photoconductor surface is increased. In Experiments A to E (Examples A to E), the minimum value determined using the expression is 70% in Experiment E (Example 5). Therefore, the occurrence of abnormal images attributable to adhesion of toner to photoconductor surfaces and degradation of photoconductors can be prevented by setting coating conditions of a lubricant powder so that the value calculated by the expression [(A0−At)/A0×100 [%]] is 70% or higher.

Experiment 5

A solid lubricant was produced as follows. A normal paraffin having a melting point of 116° C. (75 parts by mass), a normal paraffin having a melting point of 108° C. (12 parts by mass) and 13 parts by mass of a cyclic polyolefin having a melting point of 60° C. (TOPAS™ available from Ticona Co.) were put in a glass vessel with a lid. A solid lubricant was produced in a similar manner as in Experiment 2. Using this solid lubricant, the maximum thickness of a lubricant film and the value calculated by the expression [(A0−At)/A0×100 [%]] were determined in the same manner as in Experiment B (Example 2) in [Experiment 3]. The lubricant film had a maximum thickness of 0.073 μm. The value calculated by the expression [(A0−At)/A0×100 [%]] was 100%. Thereafter, the photoconductors, the coating brush rollers, and the solid lubricant sample were replaced with new ones, and then 7,000 sheets of the color test image were output in the same conditions as in Experiment 4 (temperature: 23° C., relative humidity: 50%). Further, the same output was carried out under the conditions of a temperature of 20° C. and a relative humidity of 50% as well as under the conditions of a temperature of 30° C. and a relative humidity of 85%. As a result, under any of the conditions, fine streaks were not observed in each of the output tests of 7,000 sheets (evaluation result: A).

In view of the above experimental results, in the copier according to the embodiment of the present invention, a solid lubricant containing paraffin as a main component was used, and the coatability of the solid lubricant by means of a coating brush roller as an applying member was controlled so that a maximum thickness of a lubricant film formed on a photoconductor, which is obtained after a lubricant powder scraped out from the solid lubricant was continuously applied on the surface of the photoconductor by means of the coating brush roller for 120 minutes, was 25 μm or less. With this setting, the occurrence of fine-streaky images attributable to defective exposure of photoconductors can be prevented within a tolerable range because of the reasons described above. Note that the coatability of lubricant by means of a coating brush roller can be controlled by controlling a pressing force of the solid lubricant applied to the coating brush roller and a linear velocity difference between the coating brush roller and a photoconductor. An instance in which a lubricant is applied onto a photoconductor while scraping out a lubricant powder from a solid lubricant and obtaining the lubricant powder has been explained above, however, a lubricant may be formed in a lubricant powder, and the lubricant power may be set in a process unit for use in coating.

The maximum thickness of a lubricant film formed on a surface of a photoconductor is preferably controlled so as to be 0.23 μm or less, as seen in Tables 6 and 7. The maximum thickness of a lubricant film is more preferably controlled so as to be 0.15 μm or less and still more preferably so as to be 0.03 μm to 0.10 μm. Note that the effects can be exerted if a small amount of a lubricant film exists on a photoconductor surface, and therefore the lower limit value of the maximum thickness of the lubricant film becomes the size of molecules of the lubricant powder.

In the copier according to the embodiment of the present invention, conditions for applying a lubricant by means of a coating brush roller are set such that the condition of "(A0−At)/A0×100≧70 [%]" can be satisfied. With this setting, as can be seen in the experiments, the occurrence of abnormal images attributable to adhesion of toner to photoconductors and degradation in photoconductors can be prevented. Note that the condition of "(A0−At)/A0×100≧70 [%]" can be satisfied by suitably setting, as lubricant application conditions, the pressing force of a solid lubricant applied to a coating brush roller, flocking density of fiber filaments in the coating brush roller, fiber length, fiber diameter, linear velocity difference between a photoconductor and the coating brush roller, and the like.

In the copier according to the embodiment of the present invention, as a solid lubricant, a lubricant is used, in which 40% by mass or more of a paraffin having a melting point of 70° C. to 130° C. is contained. With this constitution, a surface of a photoconductor can be excellently protected from stress due to electrostatic discharge while favorably maintaining the lubrication property between a photoconductor and a cleaning blade for a long period of time.

Hereinabove, a copier in which a photoconductor and a lubricant coater (a part of a drum cleaning device) are mounted in the form of a process unit has been explained, however, the present invention can also be used in image forming apparatuses in which any of the photoconductor and the lubricant coater is singularly provided.

Further, a copier having a mode in which each color toner images are superimposed on an intermediate transfer belt has been explained above, however, the present invention can also be used in image forming apparatuses having a mode in which each color toner images are superimposed on a recording medium (for example, recording paper) that is conveyed with being held on a surface of a paper conveyance belt and then transferred.

Furthermore, a so-called tandem type copier equipped with a plurality of photoconductors has been explained above, however, the present invention can also be used in full-color image forming apparatuses in which developing devices for each color are provided around one photoconductor as well as in monochrome image forming apparatuses.

What is claimed is:

1. A lubricant coater comprising:

an applying member for applying a lubricant powder on a surface of an image bearing member, wherein the lubricant powder comprises paraffin as a main component, and wherein the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

2. The lubricant coater according to claim 1, wherein the image bearing member is a photoconductor provided with a photosensitive layer containing a polycarbonate resin; and in C1s spectrum of an x-ray photoelectron spectroscopy (XPS), among a plurality of waveforms generated by a plurality of carbon bond structures which are different from each other in the C1s spectrum, when a dimensional ratio of a composite waveform composed of a plurality of waveforms having peaks of intensity within the range of bond energy values of 290.3 eV to 294 eV relative to the entire dimension of the plurality of waveforms under the C1s spectrum is defined as a dimensional ratio A, a relation between a dimensional ratio A0 [%] corresponding to the dimensional ratio A of the surface of the photoconductor to which the lubricant has not yet been applied and a dimensional ratio At [%] corresponding to the dimensional ratio A of the surface of the photoconductor to which the lubricant has been continuously applied for 120 minutes satisfies a condition of "$(A0-At)/A0\times100\geqq70$ [%]".

3. The lubricant coater according to claim 1, wherein the lubricant is a lubricant containing 40% by mass or more of a paraffin having a melting point of 70° C. to 130° C.

4. An image bearing unit comprising:

an image bearing member for supporting a toner image on its surface, and a lubricant applying unit configured to apply a lubricant on the surface of the image bearing member, wherein the lubricant powder comprises paraffin as a main component, and wherein the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

5. An image forming apparatus, comprising:

an image bearing unit which comprises:

an image bearing member for supporting a toner image on its surface, and a lubricant applying unit configured to apply a lubricant on the surface of the image bearing member, and an image forming unit configured to form a toner image on the surface of the image bearing member, wherein the lubricant powder comprises paraffin as a main component, and wherein the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

6. An image forming apparatus comprising:

an image bearing member for supporting a toner image on its surface, a lubricant applying unit configured to apply a lubricant on the surface of the image bearing member, and an image forming unit configured to form a toner image on the surface of the image bearing member, wherein the lubricant coatability of the applying member is controlled such that a maximum thickness of a lubricant film formed on the image bearing member, which is obtained after the lubricant powder is continuously applied on the surface of the image bearing member for 120 minutes, is 0.25 μm or less.

* * * * *